US009533407B1

(12) United States Patent
Ragner

(10) Patent No.: US 9,533,407 B1
(45) Date of Patent: Jan. 3, 2017

(54) PIVOTAL DOUBLE-ENDED MULTISOCKETS

(71) Applicant: Gary Dean Ragner, Gainesville, FL (US)

(72) Inventor: Gary Dean Ragner, Gainesville, FL (US)

(73) Assignee: Gary Dean Ragner

( * ) Notice: Subject to any disclaimer, the term of this patent is extended or adjusted under 35 U.S.C. 154(b) by 390 days.

(21) Appl. No.: 14/292,348

(22) Filed: May 30, 2014

Related U.S. Application Data

(60) Provisional application No. 61/828,681, filed on May 30, 2013.

(51) Int. Cl.
*B25B 13/06* (2006.01)
*B25F 1/04* (2006.01)
*B25F 1/00* (2006.01)

(52) U.S. Cl.
CPC ..... *B25F 1/04* (2013.01); *B25B 13/06* (2013.01); *B25F 1/003* (2013.01)

(58) Field of Classification Search
CPC ..... B25F 1/04; B25F 1/003; B25B 13/06
USPC ..... 81/121.1–124.4, 125
See application file for complete search history.

(56) References Cited

U.S. PATENT DOCUMENTS

| | | | |
|---|---|---|---|
| 1,323,056 | A | 11/1919 | Hofmann |
| 1,613,976 | A | 1/1927 | Bellows |
| 1,618,715 | A | 2/1927 | Lammers et al. |
| 1,626,730 | A | 5/1927 | Haynes |
| 2,453,901 | A | 11/1948 | Gonett et al. |
| 2,571,570 | A | 10/1951 | Hagar |
| 2,814,227 | A | 11/1957 | Cushman |
| 3,187,610 | A | 6/1965 | Russman |
| 3,680,159 | A | 8/1972 | Wharram |
| 4,840,094 | A | 6/1989 | Macor |
| 6,637,298 | B1 | 10/2003 | O'Brien et al. |
| 7,334,506 | B2 | 2/2008 | Hui |

*Primary Examiner* — Hadi Shakeri
*Assistant Examiner* — Danny Hong

(57) ABSTRACT

A pivotal multisocket comprising an outer socket body with two socket ends, at least one slidable sleeve with a interior passage, and a pivot hinge for pivoting the multisocket to multiple operational positions and a stowed position. The sleeves are user slidable between at least two usable positions to provide four or more gripping surface sizes for the pivotal multisocket.

20 Claims, 7 Drawing Sheets

Figure 2A:
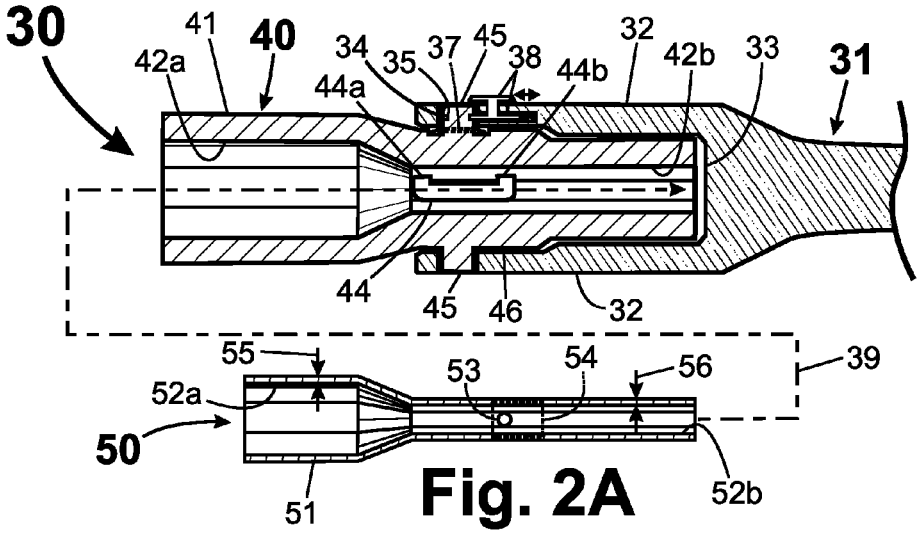

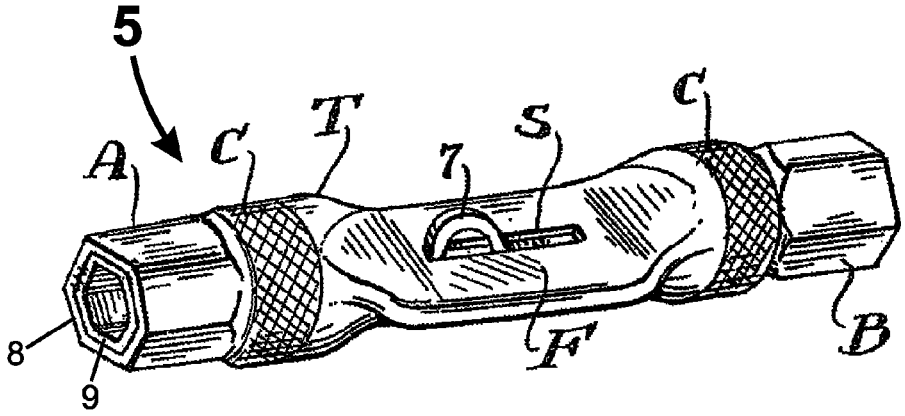
Fig. 1A - Prior Art
US PAT. 2,453,901
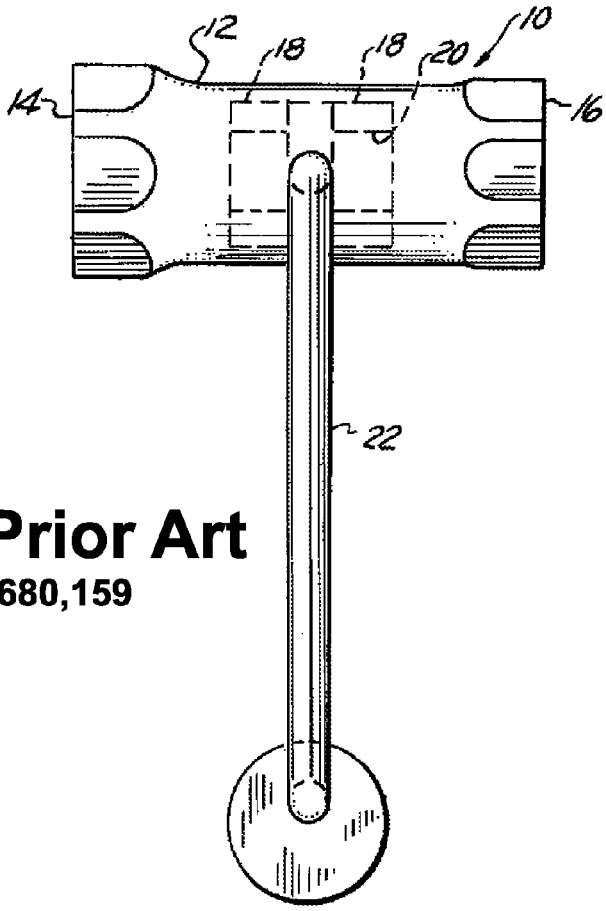
Fig. 1B - Prior Art
US PAT. 3,680,159

PIVOTAL DOUBLE-ENDED MULTISOCKETS

CROSS-REFERENCE TO RELATED APPLICATIONS

This is a Non-Provisional Application of, and claims priority and benefit of U.S. Provisional application Ser. No. 61/828,681, filed on May 30, 2013, titled: "Pivotal Double-Ended Multisockets" by the Applicant.

FIELD OF INVENTION

The field of this invention relates to wrench tools for turning rotary fasteners and more specifically wrenches with double-ended multiple sized sockets.

BACKGROUND OF INVENTION

The present state of the art for hand tools is very diverse. For wrenches and socket, they normally come in sets of five or more sizes. These sets usually come in a carrying case or other holding structure to keep the tools together. Socket sets allow the user to tighten and loosen rotary fasteners (bolts, screws, nuts, specialty fasteners, and etc.) in depressions and other hard to reach areas. Socket sets often include a ratchet wrench to turn a rotary fastener without having to remove the socket from the fastener. The disclosed multisockets as well as general wrench sockets can have many types of gripping surfaces. Wrench sockets in general can each come in a variety of gripping surfaces for use with different types of rotary fasteners. Some common socket gripping surfaces can comprise: 1) four-point standard (square shape), 2) six-point standard (hexagon shape), 3) eight-point (star shaped), 4) twelve-point standard (double hexagon), 5) twelve-point spline, 6) lobed gripping surfaces (both six and twelve point), 7) Torex® gripping surfaces, 8) asymmetric gripping surfaces, 9) variations on these basic gripping surfaces, and 10) many other shape specialty shapes for various purposes. This list of gripping surfaces is not exhaustive and many other gripping surface designs exist in the patent record that can be used with the disclosed sockets.

Most American homes have at least one socket set in their home. Prior art sockets include a multitude of ways of providing torque to various rotary fasteners, and can include a ratchet mechanism that can be bidirectional (selectively reversible) or unidirectional (ratchet action only in one direction). Single direction ratchet systems can be combined with the pivotal multisockets if the sockets can reverse their attachment to the ratchet. Along with the multiple socket sizes, this invention can also be combined with other tools, such as, but not limited to, hammers, screwdrivers, pry bars, scraping tools, box cutters, knives, saws, files (wood and/or metal), pliers, axes, and other hand tools. The socket heads themselves can have a pivot hinge pin or knobs that allow the multisocket to swivel to various angles to allow greater functionality, and can be designed to pivot to a low-profile position for stowage.

The use of the term "sockets" can be used in this patent to differentiate themselves from wrench head designs which during use have a much lower profile (height above rotary fastener during use) than a socket. Generally a socket has a longitudinal length (vertical height above the base of a rotary fastener during use) that is generally greater than its gripping surface rated size (i.e., ½ inch socket has a longitudinal length that is generally greater than ½ inch. For the double ended sockets disclosed here, the longitudinal length of the multisockets is generally greater than two times the socket's gripping size. The disclosed multisockets will generally be much longer than two times the largest socket size, and can provide a deep socket function by having a clear path down their center axis (see FIGS. 4A-B), however this open center axis (deep socket) is optional for the invention.

Wrench sockets are generally not hinged at the socket since this would make it difficult to connect and disconnect different sockets. Instead, some ratchet wrenches have built in hinges near the ratchet head to allow the socket to pivot to various angles when it is attached to that wrench. Such pivots or hinges can comprise a friction means and/or locking mechanism to help hold the ratchet head and socket at a particular angle with respect to the rest of the wrench (i.e., the wrench handle). These friction and locking means (stabilizing means) can comprise any mechanism that can be used with hand tool hinges to help hold the hinge's joint in place during use. The disclosed multisocket, because of its many gripping surfaces sizes do not need to be switched out for different sockets and can be permanently and pivotally attached to the end of the wrench. The wrench hinge(s) can include a friction and/or locking mechanism(s), as its particular use dictates.

PRIOR ART

In the prior art, various multisockets are disclosed that use slidable sleeves to change the effective gripping surface size within a socket body. Many designs exist in the prior art that provide multiple socket sizes in a single multisocket, however none were found that provide a pivotal double ended socket with three or more separate sizes.

In FIG. 1A we see U.S. Pat. No. 2,453,901 to Gonsett shows a double ended multisocket tool 5 comprising a metal tube T and an internal sleeve. The metal tube T comprises a small wrench end A, a large wrench end B, a pair of hand holding surfaces C, a flattened portion F, and a lengthwise slot S. The Inner Sleeve comprises a wrench gripping surface 9 on one end and a larger gripping surface on the other end, and a control projection 7 for sliding the inner sleeve alternately to the wrench end A and the wrench end B. Wrench end A comprises two gripping surfaces 8 and 9 on a slidable sleeve within metal tube T. Similarly, larger wrench end B comprises two wrench sizes, but are not seen in FIG. 1A. Gripping surface 9 can be used with control projection 7 in its shown position and gripping surface 8 can be used when control projection is slide to the right in FIG. 1A. Thus, this design can provide four different wrench gripping surface sizes, two on each end A and B.

In FIG. 1B we see U.S. Pat. No. 3,680,159 to Wharram comprises a pivoting double-ended spark plug wrench 10 and a wire handle 22. Spark plug wrench 10 comprises a tubular member 12, a large spark plug socket 14, a small spark plug socket 16, a pair of axial spaced tubular sleeves 18, and an aperture 20 on sleeves 18. Handle 22 is pivotally mounted on sleeves 18 and tubular member 12 to provide torque to sockets 14 and 16. Handle 22 can be pivoted to various angles as needed to reach a sparkplug. Neither Gonsett nor Wharram show a pivoting double ended multisocket with four or more socket sizes. Further, neither show a wrench system for providing two multisockets to provide eight to sixteen individual socket sizes. The disclosed pivotal multisockets teaches the use of two pivoting multisockets combined in a folded handle configuration to provide unprecedented versatility and ergonomics.

U.S. Pat. No. 2,814,227 to Cushman for a "Socket Wrench Having Socket Size Reducing Means" we see a single-sided wrench socket with two sleeves that can provide three gripping surface sizes (one additional gripping surface size for each of the two slidable sleeves). Note that Cushman places these sleeves one inside the other to provide one additional gripping surface size for each sleeve. The disclosed multisocket invention provides four positional combinations of two sleeves and can provide four different sized griping surfaces from each end of the multisocket. This is one more gripping surface size than Cushing teaches for the same number of sleeves. Also note that the disclosed multisocket uses only a single layer of sleeves (sleeves positioned next to each other around the socket interior).

SUMMARY

The disclosed pivotal double-ended multisockets comprise a pivotal double-ended socket that can provide each end with two or more gripping surface sizes (four or more gripping surface sizes per multisocket). In various configurations as many as thirty-two different gripping configurations can be achieved in a single double ended multisocket. The disclosed multisockets allow these sockets to pivot to various angles so that they can reach a rotary fastener at various angles. The disclosed invention can be designed in complimentary multisocket pairs so that a full set of socket wrench sizes can be obtained from two double-ended multisockets. The multisockets can come in a single sleeve, double sleeve, triple sleeve or quadruple sleeve designs. The single sleeve design (see FIGS. 2A-D) can have as many as four different gripping surface sizes, while the double sleeve design (FIGS. 3A through 5C) can have up to eight separate gripping surface sizes (four on each end). If a double sleeve multisocket is pivotally attached at each end of a wrench handle, then these two multisockets can be combined into a single tool to provide sixteen gripping surface sizes. This is more than enough socket sizes for a complete socket set in this single tool. The triple sleeve designs (see FIG. 6C) can have as many as sixteen separate gripping surface sizes (eight sizes on each end) in various combinations of the sleeves. With four sleeves the number of position combinations increases to sixteen which can provide sixteen different sizes on each end of the socket (total of thirty-two possible sizes). If one or more folding hinges are added to the wrench handle, then two or more multisockets can be pivoted substantially parallel and adjacent to each other (see FIGS. 5A and 6A). Thus the disclosed multisockets can be used to constructed a multitool that combines a full set of socket sizes into a single compact wrench or multitool that folds for storage. The multisockets can be attached directly with a simple pivot hinge, or connected with a pivoting ratchet mechanism. The ratchet mechanism can be single direction or reversible depending on the design. If a single direction ratchet is use the multisocket would need to be removable from the ratchet to allow the multisocket to be reversed to change the effective direction of rotation so that the ratchet can be use both to tighten and to loosen rotary fasteners.

The disclosed pivotal multisockets can be place on a folding handle with a folding hinge(s) that can be near the middle of the extended wrench to create a pocket ready multitool socket set. The folding hinge can allow the multitool to fold roughly in half for a more compact stowed position. The multitool can have one or more stowed configurations and can have a multitude of extended configurations. The exact number of stowed and extended configurations can depend on the number of separate multisockets used, the number of hinge joints, the range of motion of these hinge joints, and the arrangement of the hinge joints on the multitool.

Figure 5A:
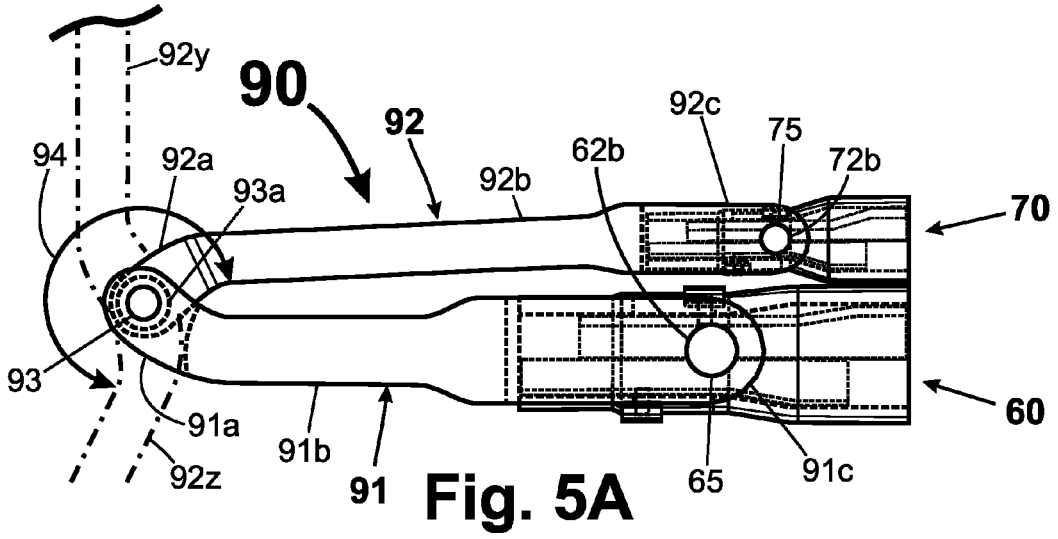
Figure 5B:
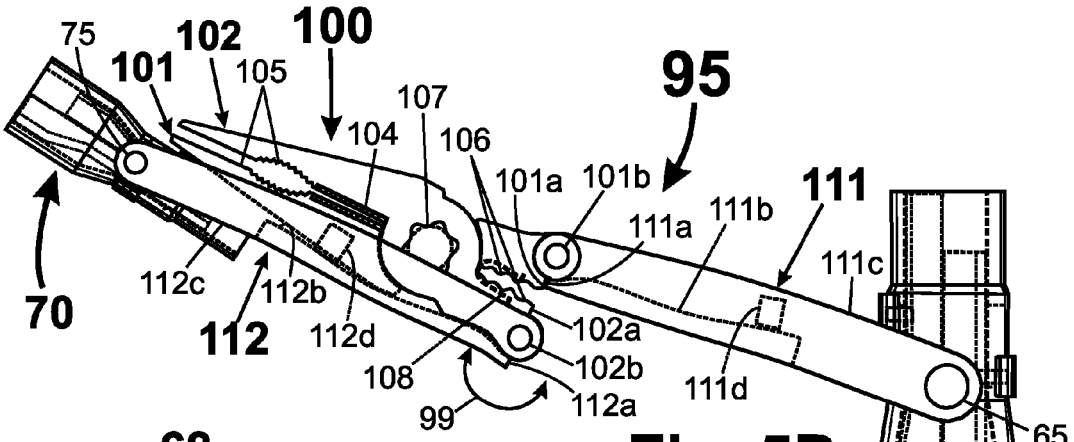

The disclosed invention can comprise a full set of wrench socket sizes combined into a single multisocket, or multisocket wrench, that can significantly reduce the overall stowed size of a sockets and wrench set. In some configurations the multisocket tool handle(s) can have different lengths to allow the wrench heads to store adjacent to the length of the handles (see tool 121 in FIG. 6A, imagine handle 92 being shorter) instead of the multisockets that fold on top of each other as seen in FIGS. 5A-B and 6A. Similarly, these folding multisocket wrench designs can pivot the tool handles to the side with an offset hinge and/or handles that can be angled to the side (handles not perpendicular to folding hinge axis.

The disclosed multisocket can be used with folding tool designs similar to those seen in the prior art and FIGS. 5A-B and 6A. These folding tools can be used to combine two or more pivotal double-ended multisockets into a foldable pocket-ready tool. Besides the folding hinges that can fold the multitool into a stowed position, each multisocket can comprise a pivotal hinge near the multisocket so that the multisocket can be angled with respect to its tool handle. Both the folding hinge(s) and the multisocket pivotal hinges can include a stabilizing means that provide sufficient friction and/or a locking mechanism in the hinge joint so that the multitool and/or multisocket can hold a particular angle selected by the user. The stabilizing means can comprise standard friction devices common to wrenches to provide a smooth controlled friction system (see FIGS. 4B and 5A) and/or multiple stable position devices and locking devices that are common to the wrench industry (see FIGS. 2A, 2C-D).

Most combination of ratchets, wrench handles, folding hinges, and socket gripping surfaces can be used to make various configurations of the disclosed multisocket wrenches using the disclosed pivotal double-ended multisocket technology. For example, a specialty gripping surface can be combined with the disclosed multisocket sleeve surfaces by designing the slidable sleeves with the specialty gripping surface. In this way a highly functional tool for a specific industry can be realized. Similarly, other tools can be combined with the multisocket sets to provide a very versatile multitool (e.g., adding pliers to the multisocket wrench (see FIG. 5B) or adding a screwdriver set to the multisocket wrench (see FIG. 6A)).

OBJECTIVES AND ADVANTAGES

Accordingly, many unique structures and advantages of my invention are:

a) To provide a pivotal double-ended multisocket with one or two socket slides that provide the multisocket with four, five, six, seven, and/or eight rotary fastener gripping surface sizes.

b) To provide a pivotal double-ended multisocket with one socket slides that provide the multisocket with up to four rotary fastener gripping surface sizes.

c) To provide a pivotal double-ended multisocket with two socket slides positioned side by side to provide the multisocket with five to eight rotary fastener gripping surface sizes.

d) The multisockets in items a) through c) wherein the multisocket comprises pivot hinge defined on the narrower end of the multisocket and is pivotal through an angle of less than three-hundred sixty degrees.

e) The multisockets in items a) through c) wherein the multisocket comprises pivot hinge defined on the wider end of the multisocket and is pivotal through a full three-hundred sixty degrees.

f) To provide a multitool with two double-ended pivotal multisockets that provide a full socket set.

g) To provide a multitool with a matched pair of double-ended pivotal multisockets, where the multitool uses the matched pair ofmultisockets to provide a full set of gripping surfaces sizes.

h) To provide a multitool with a matched pair of double-ended pivotal multisockets that comprising a full set of gripping surfaces sizes.

i) The multitools in items f) through h) further including other hand tools and/or sockets.

j) The multitools in items f) through h) further including a pliers.

k) The multitools in items f) through h) further including a screwdriver assembly.

l) To provide a folding multitool with one or more tool handles with a double-ended multisocket with three or more gripping surface sizes, wherein the one or more tool handles can be pivotally connected together at one or more hinges, and further comprising one or more additional tool handles with a tool other than a socket.

m) To provide a folding multitool with two or more tool handles with a multisocket with three or more gripping surface sizes, wherein the tool handles can be pivotally connected together at one or more hinges, and further comprising one or more additional tool handles with a tool other than a socket.

n) To provide a folding multitool with two or more tool handles with a multisocket having four or more gripping surface sizes, and at least one additional tool handle(s) supporting a tool other than a socket, such as, screwdriver, knife, hammer, pry bar, pliers, ratchet head, etc.

o) To provide a folding multitool with two or more tool handles with a multisocket having four or more gripping surface sizes, and an additional tool handle(s) supporting a screwdriver defining at least two screwdriver bit ends usable with the screwdriver.

p) To provide a multitool with two pivotal double-ended multisockets. Where the two multisockets provide a continuous range of gripping surface sizes for the multitool.

q) To provide a multitool with two pivotal double-ended multisockets. Where the two multisockets provide a continuous range of gripping surface sizes for the multitool. Wherein each multisocket provides a continuous range of gripping surface sizes.

r) To provide a multitool with two pivotal double-ended multisockets. Where the two multisockets provide a continuous range of gripping surface sizes for the multitool. Wherein each multisocket has gripping surface sizes interlaced within the range of gripping surface sizes of the other multisocket.

s) The multitools in items p) through r) wherein the multitool is foldable to a stowed position.

t) The multitools in items p) through s) wherein each double ended multisockets define one and/or two slidable sleeves for providing between three and eight different gripping surface sizes for each multisocket.

u) To provide a pivotal double-ended multisocket with two or more slidable sleeves, where one of the sleeves is substantially twice the thickness of the other sleeve.

v) The double-ended multisocket in item u) wherein on one end of at least one sleeve the thickness of that sleeve is different than its other end to provide a specific gripping surface size for that end of the multisocket.

w) To provide a pivotal double-ended multisocket with three slidable sleeves that can provide up to eight unique gripping surfaces per end of the multisocket (sixteen total gripping surfaces).

x) To provide a pivotal double-ended multisocket with four slidable sleeves that can provide up to sixteen unique gripping surfaces per end of the multisocket (thirty-two total gripping surfaces).

y) To provide a multitool with two double-ended pivotal multisockets that provide a full socket set, comprising a screwdriver assembly with a driver bit wrench set mounted on, over, or around the screwdriver assembly.

z) The multitool in item y) wherein the driver bit wrench set comprises a set of Allen wrenches.

DRAWING FIGURES

FIG. 1A Prior Art socket hand tool with slidable sleeve

FIG. 1B Prior Art pivotal double-ended spark plug socket hand tool

FIG. 2A Section and Exploded View of a pivotal double-ended multisocket 30 with a single slidable sleeve (four gripping sizes)

Figure 2B:
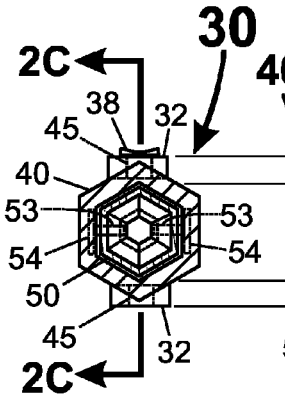
Figure 2C:
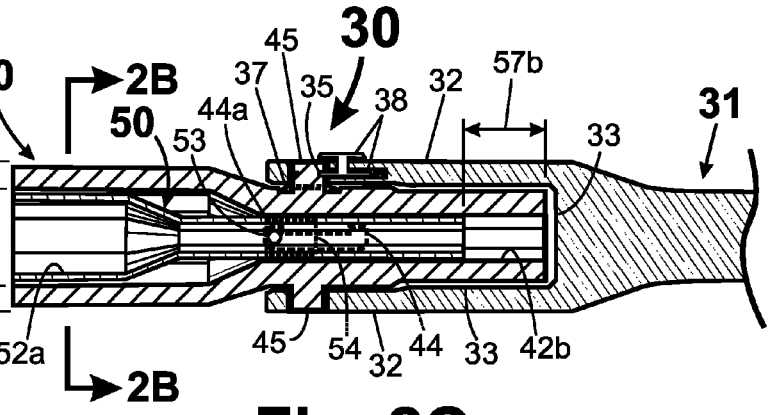

FIG. 2B Sectioned end view of multisocket 30 seen in FIG. 2C.

FIG. 2C Assembled Section side view of multisocket 30 seen in FIG. 2A-B, internal sleeve slid to the left.

Figure 2D:
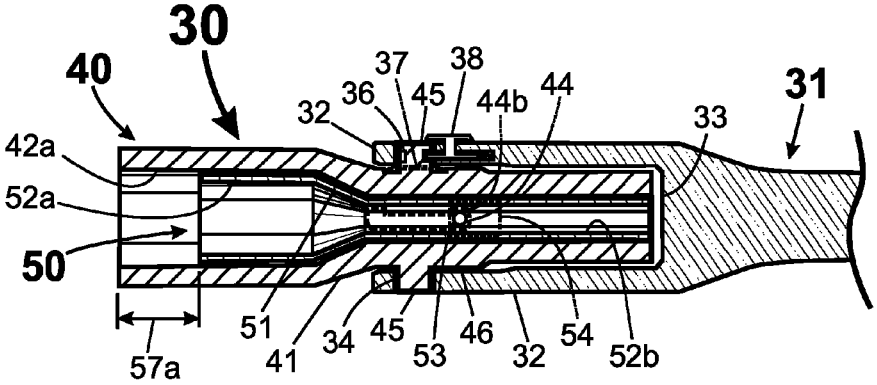

FIG. 2D Assembled Section view of multisocket 30 seen in FIG. 2A, internal sleeve slid to the right.

Figure 3A:
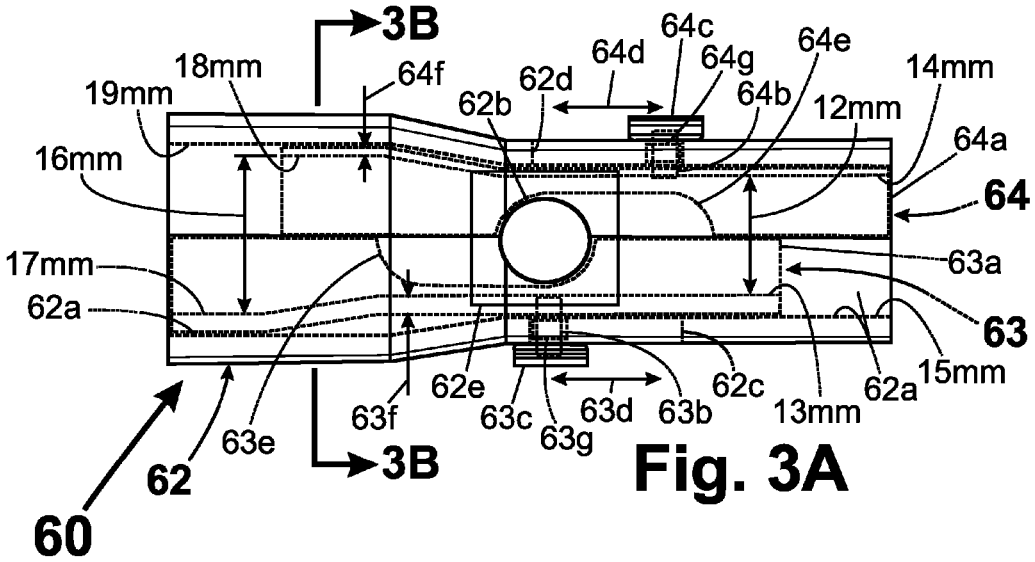
Figure 3C:
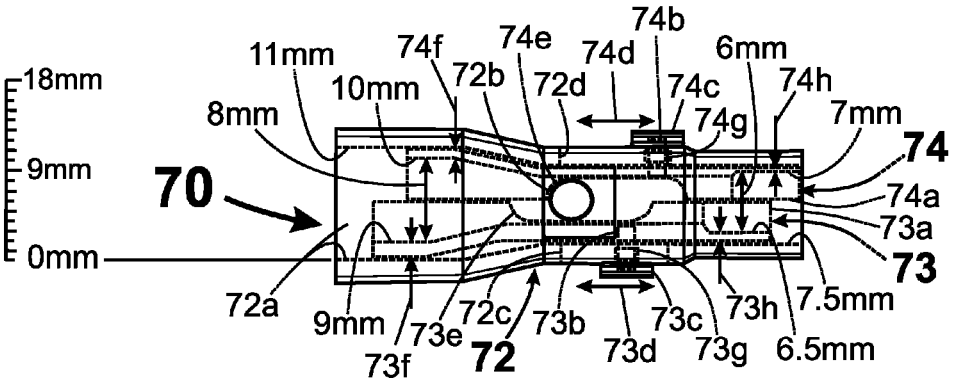
Figure 3B:
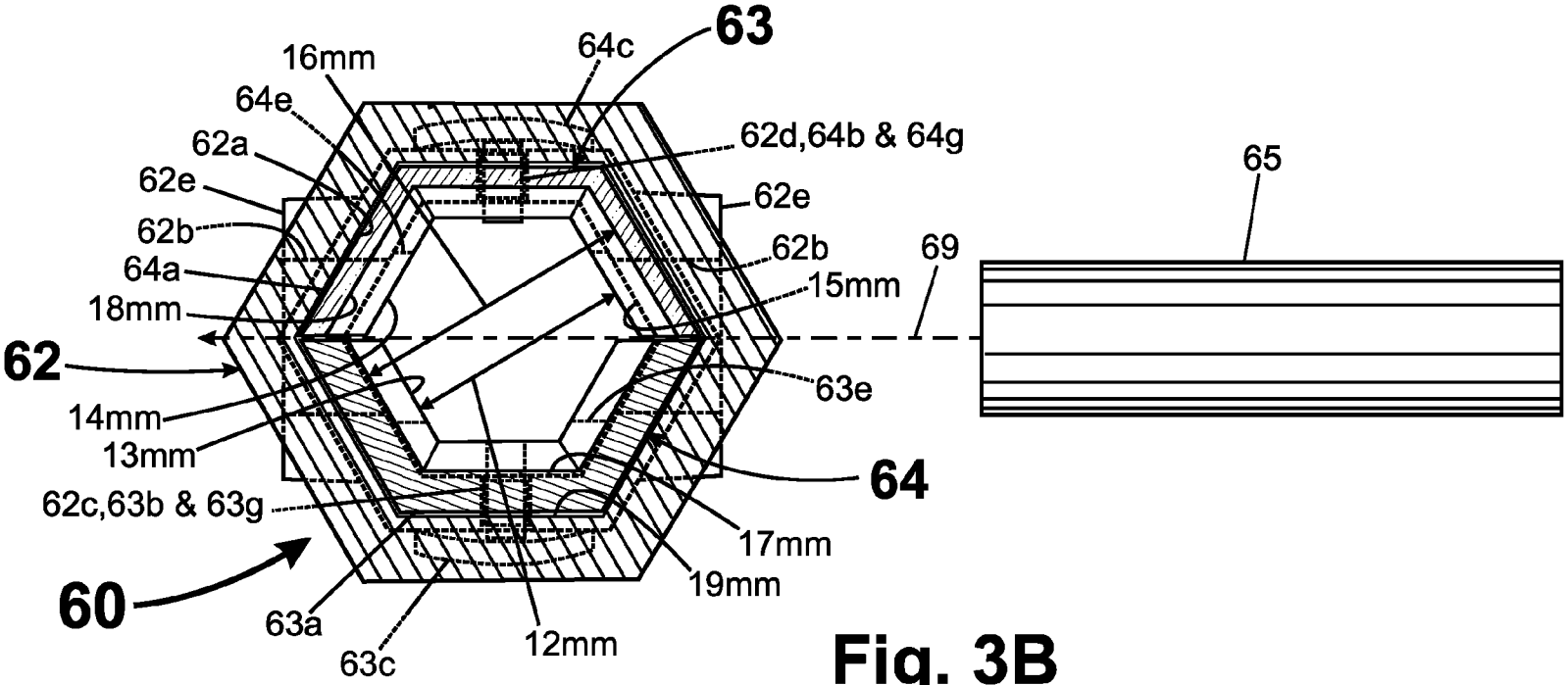

FIG. 3A Side View of double-ended pivotal multisocket 60 with two slidable sleeves FIG. 3B End View of multisocket 60.

FIG. 3C Side View of smaller complimentary double-ended pivotal multisocket 70 with two slidable sleeves to be combined with multisocket 60.

Figure 4A:
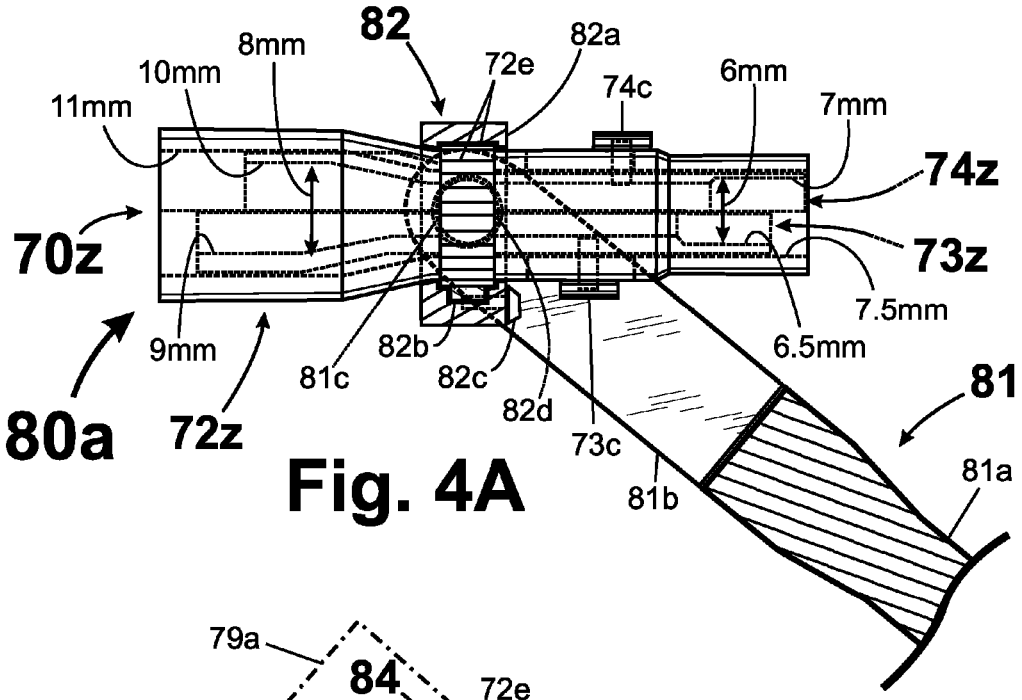

FIG. 4A Section side view of with a wrench handle 81 and a ratchet assembly 82 mounted on double-ended pivotal multisocket 70*z*.

Figure 4B:
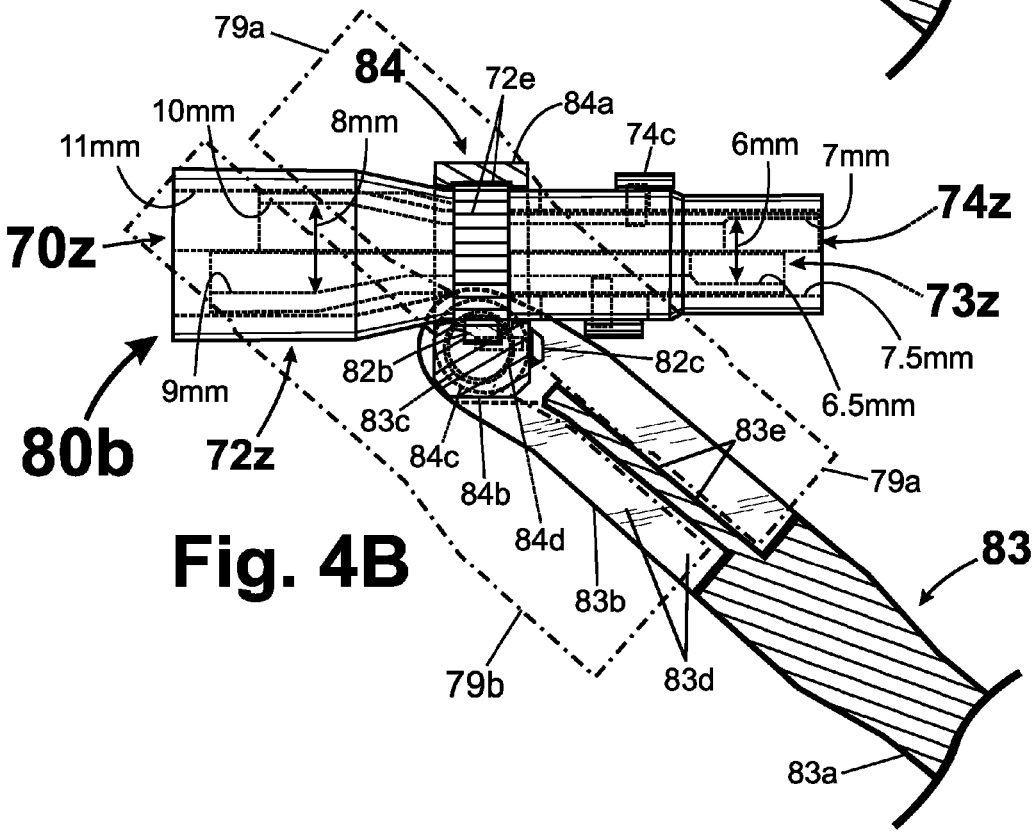

FIG. 4B Section side view of wrench handle 83 and ratchet assembly 84 mounted on double-ended pivotal multisocket 70*z*.

FIG. 5A Multitool Example 1—two pivotal double-ended multisockets that folds to a stowed position.

FIG. 5B Multitool Example 2—two pivotal double-ended multisockets with pliers that folds to a stowed position.

Figure 5C:
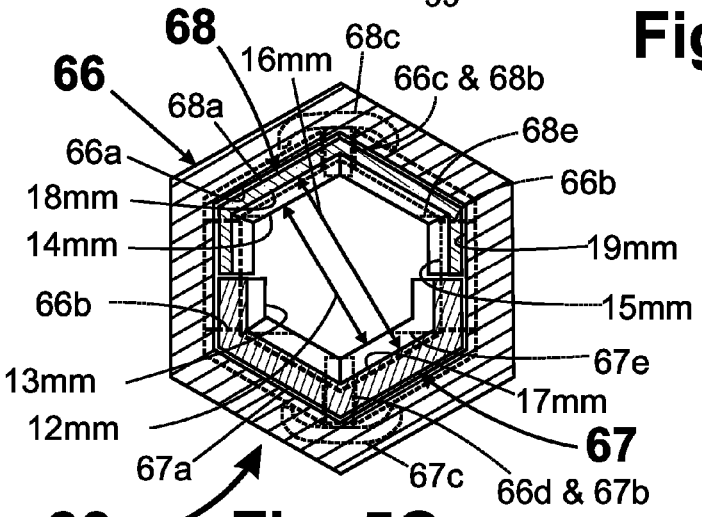

FIG. 5C End View of multisocket 60*a* which has different pivot posts locations than 60.

FIG. 6A Multitool Example 3—with two pivotal multisockets and a screwdriver assembly that folds to a stowed position.

Figure 6B:
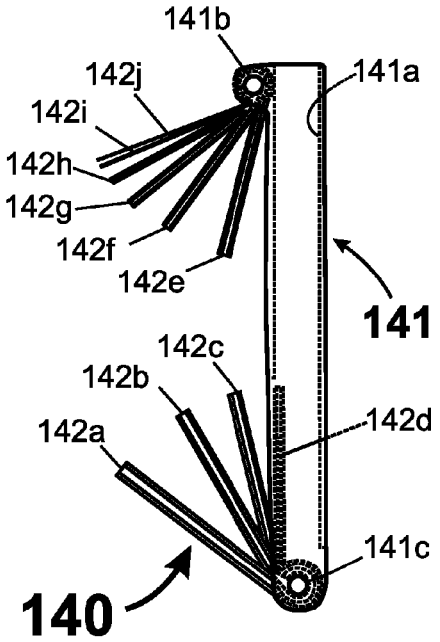
Figure 6A:
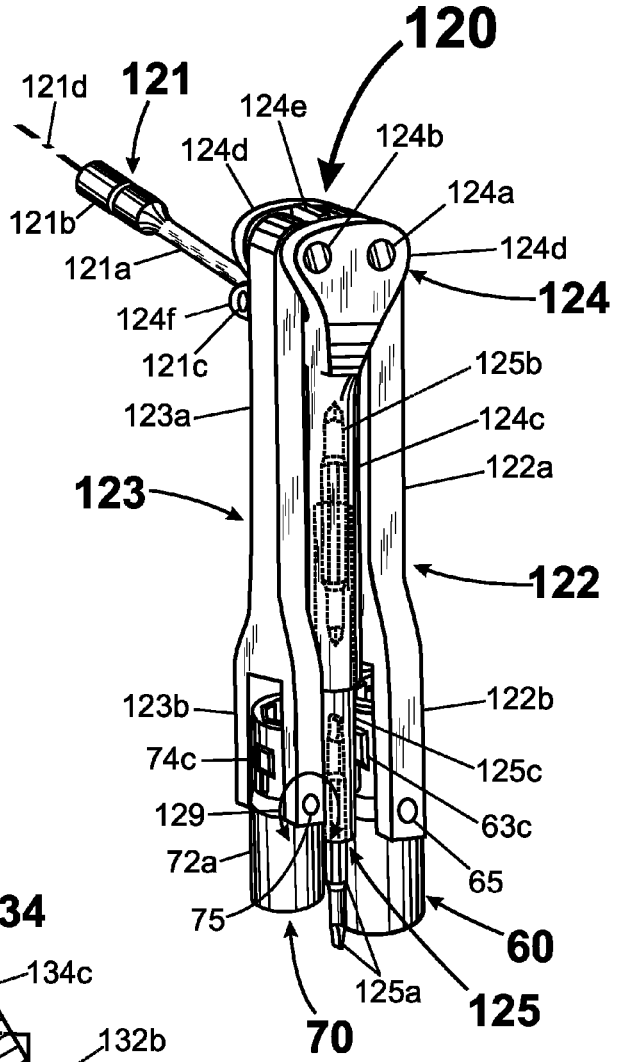

FIG. 6B Side view of Allen wrench set designed for mounting on screwdriver holder 124*c*.

Figure 6C:
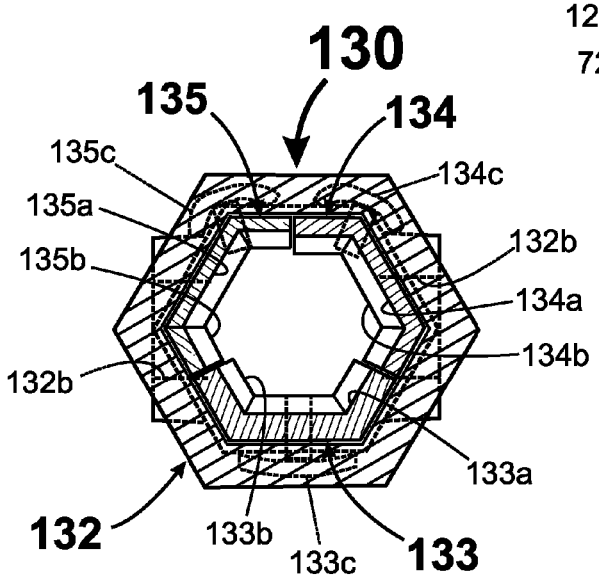

FIG. 6C Section end view of alternate multisocket with three slidable sleeves.

DEFINITIONS

PIVOT and PIVOTAL—For this patent "pivot" and "pivotal" will most often be used to refer to the ability to change the orientation of a double ended socket with respect to its tool handle. The terms can also be used to refer to the pivoting of one tool handle with respect to another tool handle and/or a hub.

SUBSTANTIALLY PARALLEL—Within twenty degrees of being exactly parallel.

SUBSTANTIALLY PERPENDICULAR—Within twenty degrees of being exactly perpendicular.

FOLDING HINGE—(sometimes referred to as a pivot hinge or pivotal hinge) A hinge that is used to fold and extend a multitool's handle.

LONGITUDINALLY ADJACENT—where two or more elongated objects (e.g., tool handles, plier arms, sockets, screwdrivers, etc.) are brought lengthwise adjacent one another and their longitudinal axes are substantially parallel to a central axis (midpoint of axes) of the collection of elongated objects.

DETAILED DESCRIPTION OF THE INVENTION

All of the multitools disclosed in this patent can be made of a hardened metal or metal alloy such as high carbon steel, chrome vanadium steel, stainless steel, titanium, aluminum alloys, cobalt alloys, etc. The materials used to make the disclosed multitool are not limited to metals, and other materials like plastics and composite materials can be used depending on the tool's use. The standard manufacturing methods of drop forging and machining, injection molding, extrusion, etc. can be used here to manufacture the disclosed multitool. The use of press fitted pivot pins, screwed in pivot pins and/or pivot tabs can provide assembly that is typical of existing wrenches and tools. Chrome vanadium steel is popular for wrenches, ratchets, hammers, screwdrivers, etc. because of its combination of relatively inexpensive cost, high strength, and good corrosion resistance. Standard tool manufacturing techniques can be used to construct the disclosed wrenches and other tools. Hinge construction on these multitools can comprise nearly any hinge structure that can support the torques and loads that will be applied perpendicular to the hinge axis during use. The folding hinges' axis can be oriented substantially perpendicular to the tools gripping surface axis so that the hinges do not need a locking mechanism in order for the user to transfer torque through the hinge to the rotary fastener. This means that when turning a vertical axis fastener the wrench hinge(s) are oriented substantially parallel to the horizontal plane that is normal (perpendicular along two axes) to the fastener's turning axis. A locking mechanism can be used on the folding hinges and multisocket pivot hinges to prevent pivoting of the hinges during use. A multitude of existing hinge locking methods and mechanisms exist in the prior art and can be used with the disclosed multitools and pivotal multisockets.

In FIG. 2A, we see an exploded section side views of pivotal double ended multisocket wrench end comprising a double-ended multisocket 30 and a wrench handle 31. Multisocket 30 comprises a double-ended outer socket 40 and a double-ended inner slidable sleeve 50. Handle 31 comprises a hinge paw 32 with a hinge paw gap 33 and pivot holes 34, a friction spring washer 37, and a latching mechanism 38. Hinge paw 32 is designed for pivotal mounting on pivot posts 45 with pivot holes 34 to allow outer socket 40 (and sleeve 50 inside it) to pivot through its desired range from of angles. Generally this designed range of motion will be between ninety and three-hundred sixty degrees in either direction from the parallel position shown in FIGS. 2A-D. Flat surfaces 46 can help support hinge paw 32 during use. Hinge paw 32 also comprise holding mechanism: 1) friction spring washer 37 and/or 2) latching mechanism 38. Latching mechanism 38 can use either locking holes 35 (see FIG. 2A) or friction notches 36 (see FIG. 2D) to hold multisocket 30 in a particular orientation during use. Nearly any of the prior art holding mechanism (friction and locking) can be used with multisocket 30, and friction spring washer 37 and latching mechanism 38 are only two examples. There are three basic types of holding mechanisms used with wrenches: 1) continuous friction mechanisms (see friction washer 37) which provide a continuous resistance to pivoting the hinge, 2) locking mechanisms (see FIG. 2A with mechanism 38 and locking holes 35) which are able to temporarily lock a pivot hinge at a particular angle, and 3) punctuated friction mechanisms (see FIG. 2D with mechanism 38 and friction notches 36) which can provide a spring loaded pin or ball that is forced into a friction notch 36 to provide multiple stable positions. Linear punctuated locking and/or friction notches 44*a-b* (holding notches) and control post 53 can provide either a locking or friction latching mechanisms depending on the shape of notches 44*a-b* and control post 53. The difference between locking and punctuated friction can be nothing more than the angle of contact between the latching mechanism and the holes or notches they engage. Thus the difference between locking holes 35 and friction notches 36 can be only the depth of the indentation. Locking holes 35 can have sharper corners than notches 36 so that once latching mechanism 38 is engaged, pivot post 45 cannot pivot without the user pulling mechanism 38 back away from holes 35. Notches 36 can have angled sidewalls so that latching mechanism 38 can slip from one notch to the next if sufficient force is applied to pivot outer socket 40. This last type of holding mechanisms are very common for pivot hinges on pivoting ratchet wrench heads and other pivoting wrench heads.

In FIG. 2A, we see that outer socket 40 comprises a socket body 41 with gripping surfaces 42*a-b*, a longitudinal control slot 44 with two holding notches 44*a-b*, and two pivot posts 45 each with a flat hinge support surface 46. Socket body 41 has a tubular shape with one large end and one smaller end. Gripping surfaces 42*a* is defined on the inside of the large end and gripping surface 42*b* is defined on the small end. Gripping surfaces 42*a-b* can be designed to grip a particular rotary fastener type and a particular rotary fastener size. In this particular example gripping surface 42*a* can be sized for a 16 mm hex-head rotary fastener, while gripping surface 42*b* can be sized for a 12 mm rotary hex-head fastener. This makes gripping surface 42*b* four socket sizes smaller than gripping surface 42*a* (assuming 1 mm socket size increments). The much smaller width of gripping surface 42*a* allows hinge paw gap 33 to be made narrower, reducing the width of hinge paw 32. With inner sleeve 50 inserted in socket body 41 (see assembly path 39) and in sliding contact with gripping surfaces 52*a* and 52*b*, socket body 41 provides sufficient support for sleeve 50 to prevent damage to the sleeve when turning a rotary fastener gripping surface sizes 15 mm and 11 mm, respectively. A second smaller matching socket can provide the two missing gripping surface sizes 14 mm and 13 mm between gripping surface 52*a* (15 mm) on inner sleeve 50 and gripping surface 42*b* (12 mm) on outer socket 40. A matching pivotal double-ended multisocket (not shown) can have two larger gripping surfaces 14 mm and 13 mm, and two smaller gripping surfaces 10 mm and 9 mm to provide a two multisocket wrench with eight sizes from 9 mm to 16 mm in increments of one millimeter. Many other combinations of gripping surface sizes can be placed on a matching pair of the disclosed multisockets. For example, pivotal double-ended multisockets 60 and 70 seen in FIGS. 3A and 3C, respectively, can provide non-interlaced gripping surface sizes so that a continuous range of sizes are formed on each multisocket.

In FIG. 2A, a control mechanism is use to allow the user to adjust the position of sleeve 51. This control mechanism can comprise longitudinal control slot 44 on the side of socket body 41, control post 53 and control pad 54. A matching slot on the opposite side of socket body 41 (sectioned away) can also be used, but a single control slot is sufficient for the user to slide sleeve 50 back and forth within outer socket 40. Control slot 44 comprises notches 44*a-b*, one on each end of slot 44, to provide a friction point (sticking point) for control post 53 that is attached to inner sleeve 50. Resiliency can be built into control post 53, and inner sleeve 50, so that it can spring into notches 44*a-b* when moved to the ends of slot 44, but is not so stiff that the user cannot slide control post 53 out of notch 44*a* or 44*b* with control pad 54. Control post 53 is drawn round in FIGS. 2A-D, but to provide good side force elasticity, control post 53 should have a thin rectangular shape that is thing and flexible in the transverse direction. This rectangular shape can provide a strong locking function for control post 53 as its longitudinal ends can catch on notches 44*a-b* to lock it in place. Control post 53, can also experience significant friction against control slot 44 as it is moved between notches 44*a-b* to give the inner sleeve a solid feel for the user. Many other friction systems can be used to hold sleeve 50 in the user position with respect to outer socket 40 (see operational positions in FIGS. 2B and 2C). Alternative locking mechanisms can allow the user to temporarily lock sleeve 50 in place. Control slot 44 is shown cut into the smaller diameter end of outer socket 40, but can just as easily be cut into the larger diameter section (section with gripping surface 42*a*). Also the sloping section between surfaces 42*a* and 42*b* can be more abrupt if desired to make the socket shorter. In alternative designs, the outer surface of outer socket 40 can be rounded as is common, instead of hexagon shaped as shown.

In FIG. 2A, we see inner sleeve 50 comprise a sleeve body with two gripping surfaces 52*a-b*, a slide control post 53, and a slide control pad 54. Inner sleeve body 51 comprises a tubular structure with a hexagon cross section that is designed to securely attach to control post 53. Inner sleeve body 51 can be assembled in outer socket 40 as shown by assembly path 39, and before control post 53 and control pad 54 are mounted on sleeve body 51. Control post 53 can be assembled through slot 44 with sleeve body 51 attached at the inside end of pin 53 and control pad 54 attached at the outside end of pin 53. Inner sleeve 50 has a particular thickness 55 at gripping surface 52*a* (large end) and a second particular thickness 56 at gripping surface 52*b* (small end). Thicknesses 55 and 56 are determined by the difference in size needed between gripping surfaces 42*a-b* and gripping surfaces 52*a-b*, respectively. Inner sleeve 50 is designed to slide smoothly within outer socket 40, with control post 53 attached to sleeve 50 and extended through slot 44. Control pad 54 is bonded onto the opposite end of control post 53 on the exterior of outer socket housing 40. Control post 53 sleeve 50 is designed with significant resiliency so that pin 53 tends to spring into locking notches 44*a* and 44*b* when slid fully to the left or right, respectively (see FIGS. 2C and 2D, respectively). This provides a high friction point, or locking point, at the ends of the range of motion of sleeve 50 (see FIG. 2C for fully left, FIG. 3D for fully right). Inner sleeve 50 is sized so that outer socket 40 provides substantial physical support for inner sleeve 50 so that significant torque can be applied to a rotary fastener with gripping surfaces 52*a* and 52*b*. The left and right thicknesses 55 and 56 of sleeve body 51 can be considerably thinner than would be practical for a socket without support from outer socket 40. In some multisocket designs, thickness 55 and thickness 56 can be the same thickness.

In FIG. 2A, pivot posts 45 can be pivotally mounted in pivot holes 34 on hinge paw 32 to provide pivotal adjustment to the orientation of outer socket 40. The range of rotation for socket 40 depends on many factors, such as, the shape of socket 40 and the spacing between pivot posts 45, etc. In this particular example, where hinge paw gap 33 is narrower than the large end of socket body 41, the range ofrotation can approximately one-hundred thirty degrees in each direction (two-hundred sixty degrees total rotation) from the position shown in FIGS. 2A-D. This is because the large end of socket body 41 (see gripping surface 42*a*) cannot fit through hinge paw gap 33. If pivot posts 45 and paw gap 33 were widened, then outer socket 40 could pivot a full three-hundred sixty degrees. In alternate designs, handle 31 and hinge paw 32 can comprise two pieces that are bolted or welded together with hinge posts 45 pivotally attached to hinge paw 32. Hinge posts 45 can be forged into socket body 41 with hinge paw 32 attached later. Alternatively, hinge posts 45 can be welded onto the sides of socket body 41, press fitted into holes on either side of socket body 41, or screwed into holes on the sides of socket body 41. Many other methods can be also used to pivotally attach socket body 41 to hinge paw 32. Alternatively, hinge posts 45 can be replaced with a pivot pin that passes completely through socket body 41 and sleeve 50. A pivot hole through socket body 41 (see FIGS. 3A-C) can provide a smooth pivot joint and a slot through sleeve body 51 can provide room for sleeve 50 to slide within socket body 41. In this way, a pivot pin can be mounted through hinge paw holes 34 and outer socket 40 to pivotally attach socket body 41 and inner sleeve 50 to hinge paw 32. Such a pivot pin can be press fitted into hinge paw holes 34, or screwed in with threads. Both of these assembly methods are commonly used to create wrench hinges with pivot pins.

In FIGS. 2A, 2C, and 2D (FIG. 2B does not show the holding mechanisms to prevent the drawing from being cluttered), we see multisocket 30 with three types of holding mechanisms (holding means): 1) continuous friction mechanisms, 2) locking mechanisms, and 3) punctuated friction mechanisms. First, continuous friction mechanisms can be as simple as a spring washer placed between the two pivoting components of the hinge. For example, friction spring washer 37 provides this function and is compressed between the end of hinge paw 32 and the outer portion of socket 40. This compression force creates a stable friction force between hinge paw 32 and socket 40 to resist rotation of socket 40 with respect to hinge paw 32. Second, the locking mechanism can comprise other locking systems and there are many ways that exist for temporarily locking a hinge in place. For example, latching mechanism 38 can be combined with locking holes 35 to provide a locking mechanism. Latching mechanism 38 comprises a spring loaded latch that is biased to engage holes 35 in pivot post 45. Thus, mechanism 38 engages holes 35 to lock outer socket 40 in a particular position. The user can pull back (see movement arrows) on the latching mechanism 38 to disengage the latch from holes 35 and allow socket 40 to pivot. Third, latching mechanism 38 can be combined with friction notches 36 (see FIG. 2D) to provide a punctuated friction hinge. Notches 36 can be more rounded than locking holes 35 so that torque placed on outer socket 40 can cause the latch on mechanism 38 to slip from one notch 36 to the next.

Besides the pivotal locking mechanism just discussed, linear locking and friction sustems can be employed to slidable sleeve 50 to allow the user to maintain the sleeves position during use. For example, either a locking mechanism or a punctuated friction mechanism can be formed between outer socket body 41 and slidable sleeve body 51 with control post 53, slot 44 and notches 44*a-b*. If control post 53 and/or notches 44*a-b* are made with rounded corners to provide a holding friction, where pin 53 can tend to slip out of notches 44*a-b* when force is applied. Alternatively, control post 53 and notches 44*a-b* can be made with sharp corners so that pin 53 will tend to lock in place within notches 44*a-b*. The user would then need to force pin 53 to the side with pad 54 to disengage pin 53 from notches 44*a-b*, and allow the user to slide sleeve 50 to a new position. In alternate designs, pin 53 might be replaced with a spring steel tab that can resiliently bend to the side and provide the biasing to lock it in place within notches 44*a-b*. Control post 53 can also provide friction stabilized movement as it slides within slot 44 by being spring biased against the upper portion of slot 44. This biasing can come from the resiliency in pin 53, sleeve 50, and/or a spring clip placed on sleeve 50, pin 53, and/or control pad 54. When sleeve 50 is slid fully left (see FIG. 2C), control post 53 springs into notch 44*a* to provide significant friction at that point to hold sleeve 50 in place within socket body 41. Similarly, if sleeve 50 is slid fully right (see FIG. 2D), control post 53 springs down into notch 44*b* to hold sleeve 50 in place within socket body 41 during use.

In FIG. 2B, we see a left end section view of the full multisocket 30 with sleeve 50 mounted within outer socket 40 mounted on handle 31. The fit between outer socket 40 and inner sleeve 50 should be snug, but should not bind within socket body 41 so that sleeve body 51 can be easily slid by the user with control pad(s) 54. In this particular design, sleeve 50 has a hexigon tube shaped and can not easily flex significantly if it binds against outer socket 40. In alternate designs sleeve 50 can be split (single slot lengthwise in sleeve body 51) so that sleeve 50 is easy to manufacture from sheet metal, and also has resiliency that can allow it to provide a consistent force against the inside surfaces of socket body 41. With the proper bending of sleeve body 51, the compression force needed to fit this split sleeve into outer socket 40 can be controlled and allow notches 44*a-b* to be eliminated. This compression force within the split sleeve can be designed to expand against socket body 41 with sufficient force to provide the desired sliding friction between outer socket 40 and the split inner sleeve. Notice that in FIG. 2B we can see that multisocket 30 has a control post 53 and control pad 54 on both the left and right sides of outer socket 40.

FIGS. 2C-D show multisocket 30 with sleeve 50 installed. In FIG. 2C, sleeve 50 is shown slid fully to the left so that gripping surfaces 52*a* and 42*b* can be used. In FIG. 2D, sleeve 50 is shown slid fully to the right so that gripping surfaces 42*a* and 52*b* can be used. This arrangement give multisocket 30 a full set of four different gripping surfaces that it can use. When a matching multisocket is added to the other end of wrench handle 31, a full set of eight different gripping surfaces can be realized.

In FIGS. 3A-B, we see a side view and a sectioned end view of multisocket 60, respectively. Multisocket 60 comprises a double-ended outer socket housing 62 (socket body), a thick double-ended inner half-sleeve 63, and a thin double-ended inner half-sleeve 64. Outer socket body 62 comprises an elongated cylindrical passageway 62*a* (elongated channel), a pivot hole 62*b* therethrough, a first longitudinal control slot 62*c*, a second longitudinal control slot 62*d*, a flat hinge area 62*e* and two rotary fastener gripping surfaces 15 mm and 19 mm. Thick half-sleeve 63 comprises a sleeve body 63*a*, a control post 63*b*, a control pad 63*c*, a slide notches 63*e*, and a friction spring clip 63*g*. Half-sleeves 63 and 64 are positioned in sliding contact with inner channel 62*a*. Control post 63*b*, control pad 63*c*, spring clip 63*g* and control slot 62*c* can provide a control mechanism that allows the user to adjust and hold the position of sleeve 63. Thin half-sleeve 64 comprises a sleeve body 64*a*, a control post 64*b*, a control pad 64*c*, a pivot notch 64*e*, and a friction spring clip 64*g*. Control post 64*b*, control pad 64*c*, spring clip 64*g* and control slot 62*d* can provide a control mechanism that allows the user to adjust and hold the position of sleeve 64. Half sleeves 63 and 64 are slidable within outer socket 62 through a range of motion 63*d* and 64*d*, respectively, with their respective control pads 63*c* and 64*c*. Note that slots 62*c-d* can comprise notches similar to notches 44*a-b* on slot 44 to provide sleeves 63 and 64 with a locking or holding friction mechanism at each end of its range of motion. Multisocket 60 can be attached to a handle with pivot pin 65 that is inserted through pivot holes 62*b* (see FIG. 3B with assembly path 69, and also FIGS. 5A-B and 6A).

In FIG. 3A, outer socket 62 can be made a strong metal that is thick enough to operate by itself as a socket wrench tool. The socket body 62 has a hollow passageway 62*a* extending from a hexagonal gripping surface 19 mm at it large end and a 15 mm hexagonal gripping surface at its smaller end. All the example sockets in this patent show hexagonal gripping surfaces, but the reader should understand that other common gripping surface types can easily be substituted. The reader should also understand that the "mm" labeling is used here to signify the millimeter size of that particular gripping surface example. Each "mm" labeled surface can be the gripping surface size for that surface when used with its corresponding gripping surface on outer socket 62, except for each end's smallest gripping surface size, which has a gripping surface measured from sleeve to sleeve (see gripping surface 16 mm and 12 mm). Table 1 below shows the gripping surface sizes for each of the four positional combinations for sleeves 63 and 64. One of these four positions is shown in FIG. 3A, where sleeve 63 is slid fully to the "LEFT" and sleeve 64 is slid fully to the "RIGHT". In this state or position, the left end (Large end) of multisocket 60 is configured to provide a 17 mm gripping surface, while the right end (Small end) is configured to provide a 14 mm gripping surface. Note that sleeves 63 and 64 must be slide to the proper end of multisocket 60 to provide the desired gripping surface sizes (see Table 1 below). The user can use control pads 63*c* and 64*c* to slide sleeves 63 and 64, respectively to their needed position inside outer socket 62. These four positional states can result in four different gripping surface sizes for each end of multisocket 60 (eight total sizes).

TABLE 1

Four Main States of Multisocket 60 seen in FIG. 3A.

| SLEEVE 63 POSITION (2 mm Thickness) | SLEEVE 64 POSITION (1 mm Thickness) | GRIPPING SURFACE SIZE (Large end) | GRIPPING SURFACE SIZE (Small end) |
|---|---|---|---|
| RIGHT | RIGHT | 19 mm | 12 mm |
| RIGHT | LEFT | 18 mm | 13 mm |
| LEFT | RIGHT | 17 mm | 14 mm |
| LEFT | LEFT | 16 mm | 15 mm |

In FIG. 3A, multisocket 60 provides four main positional states by the correct selection of thicknesses for sleeves 63 and 64, in combination and separately. In multisocket 60, thick sleeve 63 is designed with a thickness 63*f* of approximately two millimeters (2 mm), and thin sleeve 64 is designed with a thickness 64*f* of approximately one millimeter (1 mm). This allows multisocket 60 to provide four different gripping surface sizes on each end of socket body 62. The selection of the sleeves thicknesses also allow one millimeter increments for the gripping surface sizes. If both sleeves were the same thickness, then only three different gripping surface sizes could be obtained from each end of multisocket 60 (two of the four positional states would have the same gripping surface size). For a Standard socket set (gripping surface sizes in inches) the two sleeves could have thicknesses of 1/16 inch and 1/8 inch, to provide gripping surface sizes from 3/4 inch to 5/16 inch in sixteenth of an inch increments. Since 19 mm is substantially the same size as 3/4 inch, the same outside socket 62 could also be used for the standard socket sizes.

In FIG. 3A sleeve 64 is slid to the right so that its gripping surface 14 mm is slid up to the right edge of gripping surface 15 mm defined on socket body 62, and sleeve 63 is slid to the left so that its gripping surface 17 mm is slid up to the left edge of gripping surface 19 mm on socket body 62. Friction clips 63*g* and 64*g* are mounted on control posts 63*b* and 64*b*, respectively and press against the side walls of slots 62*c* and 62*d*, respectively to provide a consistent friction force on sleeves 63 and 64, respectively. Biasing of sleeve bodies 63*a* and 64*a* can also provide consistent friction against the interior wall of outer socket body 62.

In FIGS. 3A-B, pivot hole 62*b* passes completely through both sides of socket body 62 to allow a pivot pin 65 to be used as a hinge for multisocket 60 (see FIG. 3B shown pivot pin assembly path 69, hinge paw not shown). Pivot holes 62*b* are reinforced by flat area 62*e* to provide both extra strength for pivot hole 62*b* and to create a flat area for mounting to a handle on the ends of pivot pin 65. Control slots 62*c* and 62*d* are arranged perpendicular to pivot holes 62*b* to allow the user easy access to control pads 63*c* and 64*c*. Control slots 62*c-d* comprise longitudinal slots through socket body 62 and are designed to allow control posts 63*b* and 64*b* to pass through slots 62*c* and 62*d*, respectively, and connect inner sleeves 63*a* and 64*a*, and control pads 63*c* and 64*c*, respectively. Control pads 63*c* and 64*c* are attached to control posts 63*b* and 64*b* on the exterior of outer socket body 62 so that they can be used to slide sleeves 63 and 64, respectively, lengthwise inside socket body 62. Pivot pin slide notches 63*e* on sleeve 63 and pivot pin notch 64*e* on sleeve 64 provide space for pivot pin 65 to be inserted into pivot holes 62*b* and still allow sleeves 63 and 64 to slide longitudinally between their two main positions (left and right positions, see sliding motion 63*d* and 64*d*). Both sleeve 63 and 64 can be slid so that each end of its sleeve body is approximately flush with the corresponding end of socket body 62. In some designs, the sleeves may extend passed the end of socket body 62 or stop before reaching flush with the end of socket body 62. Friction spring clips 63*g* and 64*g* are inserted around control posts 63*b* and 64*b*, respectively, to help hold sleeves 63 and 64, respectively in place during use. Other locking or friction systems can be used as desired, and many other variations and changes are possible with these example pivotal double-ended multisocket designs.

In FIGS. 3A-B, multisocket 60 has eight unique gripping surface sizes. Gripping surfaces 12 mm, 13 mm, 14 mm, and 15 mm are provided by different arrangements of sleeves 63 and 64 on the right end of socket body 62. Gripping surfaces 16 mm, 17 mm, 18 mm, 19 mm are provided by different arrangements of sleeves 63 and 64 on the left end of socket body 62 (see Table 1). Notice that in FIG. 3B, control post 63*b* and spring clip 63*g* are substantially packed together in slot 62*c* and are very difficult to resolve in FIG. 3B. As such, these three components have been identified together in a single label because of their close spacing. Similarly, slot 62*d*, post 64*b* and spring clip 64*g* are labeled together because of their close proximity to each other in FIG. 3B (see FIG. 3A for a better view of these components).

In FIG. 3C, we see a sectioned side view of a matching pivotal double-ended multisocket 70. Multisocket 70 has a construction that is substantially similar to multisocket 60 except multisocket 70 has smaller sized components. Multisocket 70 has gripping surface sizes that complement the gripping surface sizes on multisocket 60 to provide a continuous set of socket sizes. Multisocket 70 comprises a double-ended outer socket 72, a thick double-ended inner half-sleeve 73, and a thin double-ended inner half-sleeve 74. Outer socket body 72 comprises an elongated passage 72*a*, a pair of pivot holes 72*b*, a first longitudinal control slot 72*c*, and a second longitudinal control slot 72*d*. Elongated inner passageway 72*a* (elongated channel) extends through socket body 72 from one end to the other and defines a small gripping surface 7.5 mm and a large gripping surface 11 mm at each end. Thick half-sleeve 73 comprises a sleeve body 73*a*, a control post 73*b*, a control pad 73*c*, a slide notch 73*e*, and a friction spring clip 73*g*. Thin double-ended inner half-sleeve 74 comprises a sleeve body 74*a*, a control post 74*b*, a control pad 74*c*, a slide notch 74*e*, and a friction spring clip 74*g*. Half-sleeves 73 and 74 are positioned in sliding contact with elongated inner channel 72*a*. Multisocket 70 can be attached to a handle with a pivot pin 75 that is inserted through pivot holes 72*b* (see FIGS. 5A-B and 6A). The operation and function of the components of multisocket 70 can be substantially the same as for multisocket 60, only with different sized components and gripping surfaces. For example, control posts 73*b* and 74*b* are used to connect control pads 73*c* and 74*c* to half sleeves 73 and 74, respectively, so that control pads 73*c* and 74*c* can be used to slide sleeves 73 and 74 to their desired operational positions on the "LEFT" or "RIGHT" ends of socket body 70*a*. Sleeves 73 and 74 and control pads 73*c* and 74*c* can slide through a range of motion shown by double arrows 73*d* and 74*d*, respectively. Friction clips 73*g* and 74*g* can be mounted on control posts 73*b* and 74*b*, respectively and used to create friction against the side walls of slots 72*c* and 72*d*, respectively to help hold sleeves 73 and 74 in place during use.

In FIG. 3C, multisocket 70 has eight unique gripping surface sizes. Gripping surfaces 6 mm, 6.5 mm, 7 mm, and 7.5 mm are provided by different arrangements of sleeves 73 and 74 on the right end of socket body 72. Gripping surfaces 8 mm, 9 mm, 10 mm, and 11 mm are provided by different arrangements of sleeves 73 and 74 on the left end of socket body 72 (see Table 2 below). Notice that this completes a full range of sixteen different gripping surfaces when combined with multisocket 60.

TABLE 2

Four Main States of Multisocket 70 seen in FIG. 3C.

| SLEEVE 73 POSITION (2 mm Thickness) | SLEEVE 74 POSITION (1 mm Thickness) | GRIPPING SURFACE SIZE (Large end) | GRIPPING SURFACE SIZE (Small end) |
|---|---|---|---|
| RIGHT | RIGHT | 11 mm | 6.0 mm |
| RIGHT | LEFT | 10 mm | 6.5 mm |
| LEFT | RIGHT | 9 mm | 7.0 mm |
| LEFT | LEFT | 8 mm | 7.5 mm |

In alternate designs, different gripping surfaces sizes can easily be obtained simply by changing the socket housing size and/or changing the sleeves' thicknesses. For example, if multisocket 60 were resized to have a large socket end size of 15/16 inches and a small socket end size of 11/16 inches and sleeves 63 and 64 were resized to a 1/8 inch thickness and a 1/16 inch thickness, respectively, then multisocket 60 could provide a full set of standard socket sizes. In Table 3, we see the resulting gripping surface sizes from making these change to multisocket 60. To provide sizes one-sixteenth of an inch apart, sleeve 63 can be 1/8 inch thick and sleeve 64 can be 1/16 inch thick. Having one sleeve substantially twice the thickness of the other sleeve allows four different sizes to be selected on each end of the multisocket with uniform changes in size. This would give a resized multisocket 60 a gripping surface range of fifteen-sixteenths inch to one-half inch in increments of one-sixteenth of an inch (see Table 3). Because these resized sleeves would have a combined thickness of 3/16 inch there is a considerable gripping surface size difference between the smallest gripping surface and largest gripping surface on a particular end of this resized multisocket. In some situations, the two sleeves might be given the same thickness to reduce the number of sizes to three on each end so that the range of sizes on a particular end is reduced (see Table 5).

In FIGS. 3A-C, the position of pivot holes 62*b* and 72*b* are shown positioned substantially along the axis of multisockets 60 and 70, respectively. This positioning is only one example for the positioning of the pivot hinge and pivot holes 62*b* and 72*b* can be placed in other locations with respect to socket bodies 62 and 72, respectively. The pivot posts can be off-set from socket bodies 62 and 72 (i.e. the off-set position of pivot hinge posts 84*d* with respect to socket body 72*z*).

TABLE 3

Alternative resized Multisocket 60 with resized sleeves 1/16" and 1/8" thick, and a socket body resized with 15/16" and 11/16" socket gripping surfaces.

| SLEEVE 63 POSITION (1/8" Thickness) | SLEEVE 64 POSITION (1/16" Thickness) | GRIPPING SURFACE SIZE (Large end) | GRIPPING SURFACE SIZE (Small end) |
|---|---|---|---|
| RIGHT | RIGHT | 15/16 inch | 1/2 inch |
| RIGHT | LEFT | 7/8 inch | 9/16 inch |
| LEFT | RIGHT | 13/16 inch | 5/8 inch |
| LEFT | LEFT | 3/4 inch | 11/16 inch |

TABLE 4

Alternative resized Multisocket 70 with resized sleeves 1/32" and 1/16" thick, and a resized socket body with 7/16" and 5/16" socket gripping surfaces.

| SLEEVE 73 POSITION (1/16" Thickness) | SLEEVE 74 POSITION (1/32" Thickness) | GRIPPING SURFACE SIZE (Large end) | GRIPPING SURFACE SIZE (Small end) |
|---|---|---|---|
| RIGHT | RIGHT | 7/16 inch | 7/32 inch |
| RIGHT | LEFT | 13/32 inch | 1/4 inch |
| LEFT | RIGHT | 3/8 inch | 9/32 inch |
| LEFT | LEFT | 11/32 inch | 5/16 inch |

In Table 4, we see a matching smaller socket designed to be combined with the larger multisocket in Table 3 and provide a full range of sizes with a two end wrench (see FIGS. 5A-B, and 6A). This alternative size matching multisocket can have a construction similar to multisocket 70, but resized to have a large socket end of 7/16 inches and a small socket end of 5/16 inches and sleeves 73 and 74 resized to a 1/16 inch thickness and 1/32 inch thickness, respectively. These smaller thicknesses allow this design to provide smaller changes between gripping surface sizes. In Table 4, we see the resulting effects of these changes on the available gripping surface sizes. Because, sleeve thicknesses of 1/16 inch and 1/32 inch are used, the gripping surface sizes are in 1/32 of an inch increments.

In Tables 3 and 4, we can see that these two disclosed double-ended multisockets could be combined on a single tool to provide a standard socket set, with a range of sizes from 7/32 to 15/16 inches, with the sizes below one-half inch in size increments of 1/32 of an inch. The two multisockets described in Tables 3 and 4 would provide sixteen socket sizes for a very complete set of gripping surface sizes.

In alternative designs, the two sleeves of the larger multisocket can have the same thickness (i.e. 1 mm, or 1/16 inch) to reduce the total number of gripping surface sizes to six (three on each end). This happens because two of the four positional combinations of two sleeve positions provide the same gripping surface size. Using only three sizes per socket end has the advantage of reducing the range of sizes for that particular socket end so that it is not too oversized for the smallest gripping surface on that end.

In Table 5, we see a reduced set of gripping surface sizes that can replace the large double-ended socket discussed in Table 3. The modified socket shown in Table 5 uses two sleeves that are both 1/16 inch thick so that only three different gripping surface sizes are possible on each end of the multisocket. This reduces the range of sizes for each socket end to only 1/8 inch, so that the overall size of the exterior socket housing will be less likely to interfere with structures around smaller rotary fasteners during use of the multisocket. Notice that the gripping surface sizes 3/4 inch and 9/16 inch gripping surface sizes have two possible states that can produce each size. This multisocket thus only has six different gripping surface sizes, three different sizes on each end. This also reduces the maximum socket size from 15/16 inch seen in Table 3 to 13/16 inch seen in Table 5. If only two sizes per end are needed, then a single sleeve can be used (see FIGS. 2A-D).

TABLE 5

Alternative Resized Multisocket 60 with resized sleeves 1/16" and 1/16" thick, and a resized socket body with 13/16" and 5/8" socket gripping surfaces.

| SLEEVE 63 POSITION (1/16" Thickness) | SLEEVE 64 POSITION (1/16" Thickness) | GRIPPING SURFACE SIZE (Large end) | GRIPPING SURFACE SIZE (Small end) |
|---|---|---|---|
| RIGHT | RIGHT | 13/16 inch | 1/2 inch |
| RIGHT | LEFT | 3/4 inch | 9/16 inch |
| LEFT | RIGHT | 3/4 inch | 9/16 inch |
| LEFT | LEFT | 11/16 inch | 5/8 inch |

In FIGS. 4A-B, ratchet multisocket wrench tool 80*a* and 80*b* are each shown using a multisocket 70*z* comprising a multisocket body 72*z*, thick half-sleeve 73*z* and thin half-sleeve 74*z*, that can have substantially the same structure as multisocket socket body 72, thick half-sleeve 73 and thin half-sleeve 74, respectively (see FIG. 3C). However, socket body 72*z*, and sleeves 73*z* and 74*z* have middle sections that are slightly longer lengthwise than outer socket 72 and sleeves 73 and 74, respectively, to allow extra space for ratchet assembly 82. Ratchet ring 72*e* is formed on the exterior of this added length of socket body 72*z* to provide the inner ratchet teeth for ratchet assembly 82. Socket body 72*z* does not define a pair of pivot holes as does socket body 72 (see pivot holes 72*b* in FIG. 3C), because ratchet housing 82*a* provides a pair of pivot posts 82*d* for forming a pivotal hinge when connected to handle 81. Sleeves 73*z* and 74*z* do not require notches 73*e* and 74*e*, respectively, since there is no pivot pin that passes through socket body 72*z*. Control pads 73*c* and 74*c* provide control for moving sleeves 73*z* and 74*z*, respectively, just as they did for sleeves 73 and 74 on multisocket 70.

In FIG. 4A, we see a multisocket wrench 80*a* comprising a pivotal double-ended ratchet multisocket 70*z*, a ratchet assembly 82, and a pivotal handle 81. Multisocket 70*z* comprises a socket body 72*z*, a thick half-sleeve 73*z*, and a thin half-sleeve 74*z*. Socket body 72*z* comprises the gripping surfaces 11 mm and 7.5 mm, and a ratchet ring 72*e* which is formed into the outer surface of socket body 72*z*. Thick sleeve 73*z* comprises gripping surfaces 6.5 mm and 9 mm, and an attached control pad 73*c* for sliding sleeve 73*z* within socket body 72*z* to the left or right end of socket body 72*z* (sleeve 73*z*, shown FIG. 4A, slid to approximately its midpoint between its left and right positions). Thin sleeve 74*z* comprises gripping surfaces 7 mm and 10 mm, and an attached control pad 74*c* for sliding sleeve 74*z* within socket body 72*z* between its right and left positions (sleeve 74*z*, shown FIG. 4A, slid to right most position). Gripping surface sizes 8 mm and 6 mm are formed by sliding both sleeves 73*z* and 74*z* to either the left or right, respectively. This provides eight different gripping surface sizes for multisocket 70*z*.

In FIG. 4A, ratchet assembly 82 comprises a ratchet housing 82*a*, a ratcheting mechanism 82*b*, a selector switch 82*c*, a pair of pivot posts 82*d*, and a ratchet ring 72*e* formed on the exterior of socket body 72*z*. Ratchet ring 72*e* can physically part of multisocket body 72*z* or bonded to the exterior of the multisocket (e.g. welded, compression fit, etc.). Ratchet housing 82*a* is shown sectioned near its midpoint to show the teeth on ratchet ring 72*e* and their engagement with ratcheting mechanism 82*b*. Pivot posts 82*d* and selector switch 82*c* are mounted on the exterior of housing 82*a*, while ratcheting mechanism 82*b* is mounted on the interior of housing 82*a* and is designed to be controllable by switch 82*c* to select the direction of rotation of socket body 72*z*. Ratcheting mechanism 82*b* can selectively allow ratchet motion of multisocket 70*z*, and its associated hardware, to rotate within ratchet housing 82*a* in one direction at a time. That is, mechanism 82*b* can alternately stop ratchet ring 72*e* from rotating within housing 82*a* in one direction at a time (i.e. a standard reversible ratchet).

In FIG. 4A, handle 81 comprises a handle portion 81*a*, a hinge paw 81*b*, and a pair of pivot holes 81*c* mounted on the end of hinge paw 81*b*. Pivot posts 82*d* on ratchet housing 82*a* are pivotally connected to pivot holes 81*c* to provide a hinge for multisocket wrench 80*a*. Handle 81 is shown sectioned lengthwise approximately along its centerline so that only one side of hinge paw 81*b* is shown. Handle 81 can allow multisocket 70*z* to pivot through three-hundred sixty degrees within pivot paw 81*b* so that the multisocket can be pivoted to any angle. If hinge paw 81*b* were made narrower so that the large end of socket body 72*z* might not pass through the gap within hinge paw 81*b*, then the pivot range can be less than three-hundred sixty degrees. In many designs, it is desirable to reduce the width of hinge paw 81*b* to make the wrench handle ends more compact. Note that full rotation of the multisocket is not necessary in order to use both multisocket ends effectively (most or all of their useful orientations can be pivoted to).

In FIG. 4B, we see a multisocket wrench 80*b* comprising a pivotal double-ended ratchet multisocket 70*z*, a ratchet assembly 84, and a pivotal handle 83. Multisocket 70*z* can be substantially the same as multisocket 70*z* seen in FIG. 4A, and comprises a socket body 72*z*, a thick half-sleeve 73*z*, and a thin half-sleeve 74*z*. Ratchet assembly 84 comprises ratchet housing 84*a*, a ratchet housing extended portion 84*b* with a pair of pivot posts 84*d* mounted on the extension, a friction washer 84*c* installed over one or more pivot posts 84*d*, a ratcheting mechanism 82*b*, a selector switch 82*c* and a ratchet ring 72*e*. Ratchet ring 72*e* is also physically part of socket body 72*z*. Ratchet housing 84*a* in section view to show the teeth on ratchet ring 72*e* and their engagement with ratcheting mechanism 82*b*. Ratcheting mechanism 82*b* and selector switch 82*c* can be the same as seen on multisocket wrench 80*a* in FIG. 4A. Ratchet ring 72*e* fits in an annular groove within ratchet housing 82*a* which keep these two components aligned and connected. Pivot posts 84*d* and selector switch 82*c* are mounted on the exterior of housing 84*a*, with housing 84*a* having an extended portion 84*b* to provide a support structure for pivot posts 84*d*. Ratcheting mechanism 82*b*, which was also used in ratchet assembly 82, is mounted on the interior of housing 84*a* and is designed to be controllable by switch 82*c*. Ratcheting mechanism 82*b* can selectively allow ratchet motion of multisocket 70*z*, and its associated hardware, to rotate within ratchet housing 84*a* in one direction at a time (i.e., a standard reversible ratchet). In alternate designs, ratchet mechanism 84 can be replaced with a solid extended post with a pivot hinge hole that can be integrated with socket housing 72. The new pivot hole can place where extended post 84*d* is located on ratchet mechanism 84 so that a single hinge pin can pass through holes 83*c* in hinge paw 83*b* and the pivot hinge hole in the solid extended post to pivotally connect multisocket to handle 81. The multisocket can then have the same range of motion as socket 80*b*, and being pivotal between positions 79*a* and 79*b*. Friction spring washer 84*c* also can be used between the solid extended post and hinge paw 83*b* to create the desired holding friction for the multisocket's pivotal hinge.

In FIG. 4B, handle 83 is shown comprising a handle portion 83*a*, a hinge paw 83*b*, a pair of pivot holes 83*c* defined on the end of hinge paw 83*b*, a notch 83*d* formed in the sides of hinge paw 83*b*, and a center support 83*e* to provide added strength to hinge paw 83*b*. Center support 83*e* connects a portion of the two arms of hinge paw 83*b* together (one is cut away in drawing) to provide added strength for the hinge. Notch 83*d* can be an angled cut into the side arms of hinge paw 83*b* to provide room for the large end of multisocket 70*z* to fold substantially parallel to handle body 83*a*. Hinge paw 83*b* can optionally be angled slightly at its ends (as seen in FIG. 4B) so that pivot holes 83*c* are slightly offset from the center line of handle 83 to help provide additional space for large end of multisocket 70*z* to fold substantially parallel to handle portion 83*a*. Pivot posts 84*d* on ratchet housing 84*a* are pivotally connected to pivot holes 83*c* to provide a hinge for multisocket wrench 80*b*. Handle 83 is shown sectioned lengthwise approximately along its centerline so that only one side of hinge paw 83*b* is shown. Hinge paw 83*b* can allow multisocket 70*z* to pivot with respect to handle 83 through an angle of approximately one-hundred eighty degrees so that all useful orientations for both ends of multisocket 70*z* can be reached. The full range of motion for multisocket 70*z*, this particular design, is shown by the two end positions 79*a* and 79*b*. Both end positions represent a possible stowed position for multisocket 70*z*. Note that one-hundred eighty degrees of rotation is sufficient to provide any orientation of both ends of multisocket 70*z* with respect to handle 83 (not considering the angled tips of hinge paw 83*b*). This includes the parallel orientation where handle 83 can be used like a screwdriver to turn rotary fasteners with the large end in position 79*a*, or with the small end in position 79*b*. Friction washer 84*c* can be mounted on one or both pivot posts 84*d* and compressed between hinge paw 83*b* and extended housing portion 84*b*. This placement provides a relatively constant friction to exist between handle 83 and multisocket 70*z* so that the user can position multisocket 70*z* at a particular orientation and have friction hold it in place during normal use.

In FIG. 4B, pivot posts 84*d* on the extended portion 84*b* of ratchet housing 84*a* are offset from the centerline of multisocket 70*z*. This offset allows multisocket 70*z* to pivot to the sides of hinge paw 83*b* without having to pass through the hinge paw to pivot parallel with handle portion 83*a* (see positions 79*a-b*). This allows hinge paw 83*b* to be made narrower than possible if the ends of multisocket 70*z* needed to pass through the hinge paw. Thus, hinge paw 83*b* can be designed so that multisocket 70*z* cannot pivot beyond positions 79*a-b* shown because of the structure of hinge paw 83*b* (i.e. center support 83*e* and width of the hinge paw). This provides two stable position for stowage and also for a screwdriver mode for each end of multisocket 70*z*, where positions 79*a-b* allow multisocket 70*z* to folded longitudinally substantially onto center support 83*e*. In these position, multisocket 70*z* is in a stable position while pressed onto a rotary fastener to be turned by handle 83*a* like a screwdriver. Multisocket 70*z*, and ones similar to it, can be installed on a variety of wrench systems, including folding multisocket tools 90, 95, and 120 seen in FIGS. 5A, 5B, and 6A, respectively. For example, multisocket 70*z*, along with ratchet assembly 82 or 84, can replace multisocket 70 on folding handle 92 (see FIG. 5A) with only minor modifications to hinge paw 92*c*. Similarly, the wrenches shown in FIGS. 5B and 6A can also use ratchet multisockets wrenches similar to multisocket wrenches 80*a* and 80*b* seen in FIGS. 4A-B, respectively.

In FIG. 5A, we see multisocket wrench 90 comprising the previously discussed pivoting multisockets 60 and 70 mounted on folding handles 91 and 92, respectively, with a hinge paw 91*a*, a hinge post 92*a*, a folding hinge pin 93 and a friction disk 93*a* forming a folding hinge for wrench 90. The pivot range of handle 92 with respect to handle 91 is shown by range arrows 94, which is approximately two-hundred and forty degrees around pivot pin 93. Position 92*z* shows the fully rotated position of handle 92 with respect to the shown position of handle 91 while the shown position of handle 92 shows its stowed position. Multisockets 60 and 70 can be the same as discussed previously and can be pivotally mounted with pivot pins 65 and 75, respectively to their respective handles 91 and 92. Handle 91 comprises a hinge paw 91*a* at the folding hinge, a handle body 91*b*, and a pivot hinge paw 91*c* designed for pivotal attachment of multisocket 60. Handle 92 comprises a hinge post 92*a* at the folding hinge, a handle body 92*b*, and a pivot hinge paw 92*c* designed for pivotal attachment of multisocket 70. Pivot pin 65 is installed through hinge paw 91*c* on handle 91 and pivot holes 62*b* on multisocket 60 (see FIGS. 3A-B) to provide a pivotal hinge for multisocket 60. Pivot pin 75 is installed through hinge paw 92*c* on handle 92 and through pivot holes 72*b* on multisocket 70 (see FIG. 3C) to provide a pivotal hinge for multisocket 70. Hinge paw 91*a* and hinge post 92*a* on handles 91 and 92, respectively, are pivotally connected with folding hinge pin 93. Spring biased friction disk 93*a* is compressed between hinge post 92*a* and the inside wall of hinge paw 91*a* to provide a relatively constant friction force resisting the pivoting of handles 91 and 92 with respect to each other during use. Other friction and/or locking mechanisms can be used with folding hinge pin 93 and/or pivot pins 65 and 75 to hold or lock the handles and/or multisockets in particular desired position.

In FIG. 5B, we see multisocket wrench 95 with the disclosed pivoting multisockets 60 and 70 mounted on folding handles 111 and 112, respectively. Handles 111 and 112 also form the handles of a folding needle nose pliers 100. Both handles 111 and 112 have a pivot arrange of approximately one-hundred eighty degrees (see pivot range 99 for handle 112). Multisockets 60 and 70 can be the same as discussed previously and be pivotally mounted to handles 111 and 112 with pivot pins 65 and 75, respectively. Handles 111 and 112 can be designed to fold neatly against needle nose pliers assembly 100 which comprises a rear plier section 101, front plier section 102, a plier hinge 107 pivotally connecting sections 101 and 102 of the pliers, and a spring clip 108 for biasing sections 101 and 102 to automatically open jaws 105 for use. Folding needle nose pliers 100 can comprise a plier cutters 104, a needle nose plier jaws 105, a crimping and/or wire stripping tool 106, and other tools common to pliers. Rear plier section 101 comprises a pivot stop 101*a* and a folding hinge 101*b*. Front plier section 102 comprises a pivot stop 102*a* and a folding hinge 102*b*. Folding hinges 101*b* and 102*b* are designed to pivotally attached handles 111 and 112 to pliers sections 101 and 102, respectively. Handle 111 comprises a pivot stop 111*a*, a channel body 111*b*, a hinge paw 111*c* and a spring clip 111*d*. Handle 112 comprises a pivot stop 112*a*, a channel body 112*b*, a hinge paw 112*c* and a spring clip 112*d*. Each handle 111 and 112 can pivot from a closed or stowed position (see handle 112 in FIG. 5B), to a fully extended position (see handle 111 in FIG. 5B). In the stowed positions, channel bodies 111*b* and 112*b* slide over pliers sections 102 and 101, respectively to provide a compact stowed position. In this stowed position, spring clips 111*d* and 112*d* can grip the sides of sections 102 and 101, respectively to help keep pliers jaw 105 closed while stowed. In their extended positions, pivot stops 111*a* and 112*a* are in contact with pivot stops 101*a* and 102*a*, respectively so that handles 111 and 112 can not pivot further in their respective directions and multisockets 60 and 70 can be used as hand grips for pliers 100. This allows handles 111 and 112 to operate as handles for needle nose pliers 100 and spring clip 108 can provide a restoring force to provide spring action to handles 111 and 112 for more user friendly operation of pliers 100. Spring clips 111*d* and 112*d* can be used to grip the sides of the plier sections 102 and 101, respectively, and hold plier assembly 100, arms 111 and 112, and multisockets 60 and 70 in a stowed position (see handle 112 and multisocket 70 in FIG. 5B). Pivotal hinge pins 65, 75, 101*b*, and 102*b* can all include holding mechanisms similar to latching mechanism 38 and friction washer 37 seen in FIGS. 2A and 2C, or a spring biased friction washer 84*c* seen in FIG. 4B, or other locking or friction systems that is common to pivotal hand tools.

In FIG. 5B, handle 112 and multisocket 70 are seen folded snugly around plier section 101. This snug fit between handle 112 and plier section 101, and handle 111 and plier section 102 (when folded and stowed) tends to hold plier jaws 105 closed for stowage and resists the biasing force of spring clip 108. In FIG. 5B, this snug arrangement between handles 111 and 112, and plier sections 102 and 101, respectively, can be used to direct side torque applied to handle 112 and multisocket 70 and transfer these torques across hinge 107 without putting undue stress on that hinge itself. This is accomplished by having handle 112 actually providing a channel 112*b* and spring clip 112*d* to grip the plier end of plier section 101 so that torque can be transferred from multisocket 70, through handle 112, into pliers section 101, through hinge 101*b*, and into handle 111 to turn multisocket 60 around axis 98 for use. Thus, in the configuration shown in FIG. 5B, multisocket 60 has a functional long handle that comprises handles 111 and 112, multisocket 70, and pliers assembly 100. A similar situation exists when handle 112 is extended, and handle 111 is folded against plier section 102. Then handles 111 and 112, multisocket 60 and pliers assembly 100 can be used as a long handle for multisocket 70. When both handles are extended, multisockets 60 and 70 provide rounded hand grips for handles 111 and 112 for using pliers assembly 100.

In FIG. 5C, we see a cross section end view of an alternate pivotal multisocket 60*a* that has its internal sleeve structure has been reshaped to place their intersection on the flat sides of outer socket 66 instead of at the corners as seen in multisockets 60, 70, and 70*z*. Pivot holes 66*b* and control slots 66*c-d* have also been rotated thirty degrees with respect to its outer socket 66 when compared to previously discussed pivotal multisockets 60, 70, and 70*z*. This allows this example to maintain the previous orientations of the control pads (top and bottom), and pivot holes (side to side) that is seen in FIGS. 3A-C and 4A-B.

In FIG. 5C, multisocket 60*a* comprises an outer socket 66, a thick half-sleeve 67, and a thin half-sleeve 68. Outer socket 66 comprises an elongated channel 66*a*, two pivot holes 66*b* for mounting on a hinge pin 65, two control slots 66*c* and 66*d*, and rotary fastener gripping surfaces 19 mm and 15 mm. Sleeve 67 comprises a sleeve body 67*a* that can be two millimeters thick and shaped to the contours of the interior surface 66*a* of socket body 66, a control post 67*b*, a control pad 67*c*, a notch 67*e*, and gripping surfaces 17 mm and 13 mm. Sleeve 68 comprises a sleeve body 68*a* that can be one millimeters thick and shaped to the contours of the interior surface 66*a* of socket body 66, a control post 68*b*, a control pad 68*c*, a notch 68*e*, and gripping surfaces 18 mm and 14 mm. Two additional gripping surface sizes 16 mm and 12 mm are achieved by combining the gripping surfaces of both sleeves at the same time.

In FIG. 5C, half-sleeves 67 and 68 are adjacent each other at an edge between corners of elongated channel 66*a* and in sliding contact with elongated channel 66*a*. In previous designs, half-sleeves 63 and 64 are adjacent at the corners of socket body 62. Sleeves 63 and 64 are slightly less likely of slipping out of position within elongated passageway 62*a*, than sleeves 67 and 68 are of slipping out of position within elongated channel 66*a*. However, at the thicknesses of 2 mm and 1 mm for the sleeves, both sleeve designs strongly resist slipping past one another during use. Also, the use of control posts 67*c* and 68*c* tend to keep sleeves 67 and 68 in their proper positions by interacting with slots 62*c-d*. Similarly, pivot pin 65 passing through multisocket 60*a* can interact with notches 67*e* and 68*e* to help keep sleeves 67 and 68, respectively in place. Pivot pin 65 can also interact with the ends of notches 67*e* and 68*e* to limit the longitudinal movement of sleeves 67 and 68, respectively. Thus, both methods of shaping the thick and thin half-sleeves can work well. Control post 67*b* and control pad 67*c* are fixed to sleeve body 67*a* through slot 66*d* to provide the user with a means to easily slide sleeve body 67*a* longitudinally within socket body 66. Similarly, control post 68*b* and control pad 68*c* are fixed to sleeve body 68*a* through slot 66*c* to provide the user with a means to easily slide sleeve 68 longitudinally within socket body 66. Notice that pivot holes 66*b* go through the flat sides of outer socket 66 instead of through the corners of its hexagon shape as seen on outer socket 62. This can allow the width of an attached hinge paw to be made slightly narrower for multisocket 60*a* than for multisocket 60 (see FIGS. 3A-B), which can allow for a more compact multisocket wrench of similar sized sockets. Notice that the gripping surface sizes of multisockets 60 and 60*a* are substantially the same, though their sleeves have much different cross-sectional shapes.

In FIG. 6A, we see a perspective view of a multisocket tool 120 which shows how multisockets 60 and 70 might be combined with a screwdriver assembly 125 and other tools. Multisocket tool 120 comprises two pivotal multisockets 60 and 70, mounted on pivotal handles 122 and 123, respectively, a specialty socket tool 121, a central hub 124 and a screwdriver assembly 125. Multisockets 60 and 70 can be the same construction as previously discussed. Handle 122 comprises a handle body 122*a*, and a hinge paw 122*b* for pivotally attaching multisocket 60 with pivot pin 65. Handle 123 comprises a handle body 123*a*, and a hinge paw 123*b* for pivotally attaching multisocket 70 with pivot pin 75. In this particular example, each pivotal multisocket 60 and 70 can have a pivot range 129 of approximately two-hundred forty degrees, which is more than enough to pivot both ends multisockets 60 and 70 to most of their useful orientations. However, the large ends of multisockets 60 and 70 cannot pivot directly away from central hub 124 in this design, so those larger ends cannot be use like a screwdriver. However, pivotal handles 122 and 123 can easily be modified either like handle 81 which allows three-hundred sixty degree rotation, or handle 83 which allows rotation between the two parallel socket positions 79*a* and 79*b*, to allow screwdriver like operation for all gripping surfaces. To make such screwdriver operation practical with multisockets 60 and 70, optional locking mechanisms can be added to the hinges at pivot pins 65 and 75 to hold the multisockets fixed during use.

In FIG. 6A, central hub 124 comprises two folding hinge pins 124*a-b*, a screwdriver holder 124*c*, a double hinge paw 124*d*, a pivot stop 124*e*, and a pivot hinge 124*f*. Folding hinge pins 124*a* and 124*b* are used to pivotally attach handles 122 and 123, respectively to double hinge paw 124*d*. Screwdriver holder 124*c* is designed to reversibly hold screwdriver assembly 125. Handles 122 and 123 are pivotally attached at hinge pins 124*a-b*, respectively on double hinge paw 124*d*. Screwdriver assembly 125 stops the rotation of handles 122 and 123 past the screwdriver and pivot stop 124*e* is designed to stop rotation of handles 122 and 123 past a vertically upward position in FIG. 6A. In this way, when handles 122 and 123 are rotated vertically upward, the user can grip multisockets 60 and 70 and squeeze them together to put pressure on stop 124*e* and substantially make handles 122 and 123, and central hub 124 operate as a rigid member allowing screwdriver assembly 125 to easily be used while squeezing multisockets 60 and 70 together. Screwdriver assembly 125 comprises a small double ended screwdriver bit 125*a*, a large double-ended reversible screwdriver bits 125*b*, and a reversible screwdriver insert 125*c* for holding screwdriver bits 125*a-b* during use and storage. This type of screwdriver assembly is well known in the tool industry. Multisocket tool 120 also comprises an optional specialty tool 121 comprising a handle 121*a*, a specialty tool 121*b*, and a pivotal hinge 124*f* attaching it to central hub 124. In the configuration shown in FIG. 6A, specialty tool 121 can provide torque along axis 121*d* by using the remainder of multisocket tool 120 as a handle.

The reader should understand that many other hand tool combinations are possible with the disclosed design. For example in FIG. 6A, central hub 124 can be modified to support nearly any hand tool desired to provide a multisocket wrench for a specific industry. Screwdriver assembly 125 might be replaced or combined with a hammer, a pry bar, a saw blade, a grommet removal tool, a brake spring removal tool, or nearly any other specialty hand tool. Also, for the automobile industry one might added a sparkplug removal socket and extension to allow easy sparkplug removal. Multisocket 60 is already sized for removal of 16 mm (⅝ inch) sparkplug with the smallest gripping surface size on its large end. However, the larger outer socket diameter of socket body 62 could prevent the socket from actually reaching the sparkplug of many models of cars (sparkplug is generally recessed in a tight hole in the engine block.). To get around this, the gripping surface sizes on multisockets 60 and 70 might be designed with one millimeter larger gripping surfaces so that the small end of socket body 62 provides the 16 mm (⅝ inch) sparkplug socket size instead of the large end. This would provide a normal exterior socket size (both sleeves slid away from the small diameter end) leaving only the wall thickness of outer socket body 62. To further refine the multisocket for use as a sparkplug remover, the exterior corners on hexagon shaped outer socket body 62 can be rounded off, the control pads 63*c* and 64*c* can be made very low profile or even recessed in slots so they don't interfere with the rotation of socket body 62, and the small end of socket body 62 might be made slightly longer to move hinge allow it to reach down into recessed areas to remove a sparkplug. Thus the reader should understand that many variation on the basic pivotal double ended multisocket design can be realized with different gripping surface sizes, socket body lengths, pivot hinge position, pivot hinge rotation range, and many other factors that are adjustable to provide a particular set ofproperties for a pivotal double-ended multisocket tool.

In FIG. 6B, we see a side view of an allen wrench assembly 140 comprising an elongated body 141 and ten allen wrenches 142*a* through 142*j*. Wrench assembly 140 is one example of how additional hand tools can be added to the basic pivotal double-ended wrench designs disclosed here. In this example, allen wrench assembly 140 is designed to mount on screwdriver holder 124*c* to provide a large number of both internal and external rotary fastener drivers in one tool. Elongated body 141 comprises a connector port 141*a* for mounting to screwdriver holder 124*c*, a first pivot hinge 141*b* for pivotally attaching allen wrenches 142*e* through 142*j* to body 141, and a second pivot hinge 141*c* for pivotally attaching allen wrenches 142*a* through 142*d* to body 141. Elongated body 141 is designed to slip snugly over screwdriver holder 124*c* with connector port 141*a* providing sufficient friction against holder 124*c* to hold assembly 140 in place during normal use. Assembly 140 can be inserted over screwdriver holder 124*c* until second pivot hinge 141*c* comes into contact with the end of screwdriver bit 125*a* (when in position seen in FIG. 6A). This inserted position would be the wrench assembly's fully stowed position with allen wrenches 142*a-j* facing outward and pivot hinges 14 lb-c substantially perpendicular to handle hinge pins 124*a* and 124*b*. This gives the combined multisocket tool 120 and allen wrench assembly 140 a compact stowed position. When one of the allen wrenches 142*a-j* or screwdriver assembly 125 is needed, allen wrench assembly 140 can be detached from screwdriver holder 124*c* to use either set of tools. When finished, allen wrench assembly 140 can be slipped back onto screwdriver holder 124*c* for stowage.

In FIG. 6C, we see a cross section end view of an alternative pivotal double-ended multisocket 130 comprising an outer socket 132, a first slidable sleeve 133, a second slidable sleeve 134, and a third slidable sleeve 135. The hidden lines for many of the hidden surfaces of socket body 132 and sleeves 133, 134, and 135 are not shown in this drawing to keep it uncluttered, and the discussion will focus mainly on the placement of the three sleeves within socket body 132. However, the operation of the multisocket, and attachment of a hinge paw, and shape of the outer socket body can be similar to multisocket 60, but with an additional sleeve and control pad. Outer socket 132 comprises a pair of hinge holes 132*b*. Socket body 132 can have a similar shape to socket body 62, but has three control slots (not labeled) instead of just two for connecting sleeves 133, 134, and 135 with control pads 133*c*, 134*c*, and 135*c*, respectively. Sleeve 133 is the thickest sleeve and comprises a large gripping surface 133*a*, a smaller gripping surface 133*b*, and a control pad 133*c*. Sleeves 133, 134, and 135 each have a widened "U" shape, or truncated "V" shape, so that they each cover approximately one-third of the interior surface of socket body 132. Sleeve 134 is the medium thickness sleeve and comprises a large gripping surface 134*a*, a smaller gripping surface 134*b* and a control pad 134*c*. Sleeve 135 is the thinnest sleeve and comprises a large gripping surface 135*a*, a smaller gripping surface 135*b* and a control pad 135*c*. Sleeves 133, 134, and 135 fit within socket body 132 with tight tolerances so that the interior wall of socket body 132 and side edges of the three sleeves substantially prevent the sleeves from slipping out of their radial positions within the socket body and limit their movement in substantially the longitudinal direction within socket body 132. The interfaces between the sleeves are located near the center of the straight portions of the inner gripping surface of socket body 132, such that, control pads 134*c* and 135*c* can reach their respective sleeve 134 and 135, respectively without interfering with an attached hinge paw (attached at pivot holes 132*b*. Control pads 134*c* and 135*c* are closely spaced on the top portion of socket body 132, while control pad 133*c* for sleeve 133 is positioned by itself on the bottom portion of socket body 132. This arrangement allows three separate sleeves to be controlled from the exterior of the socket body. Note that a four sleeve design can easily be made by simply positioning two control pads on the bottom portion of socket body 132 similar to the two control pads 134*c* and 135*c* on the top portion of socket body 132 and having each of the four sleeves cover approximately one-forth of the interior gripping surface of socket body 132 (e.g. each sleeve filling one quadrant of the interior channel (interfaces placed along horizontal and vertical lines going through the center of the multisocket)).

In FIG. 6C, the three sleeves 133, 134, and 135 provide three different gripping surfaces for each end of multisocket 130. These three sleeves can have eight unique positional combinations, that can give multisocket 130 a total of eight different gripping surface sizes per socket end, or sixteen different gripping surface sizes for the entire multisocket. In FIG. 6C, sleeves 133, 134, and 135 are shown with thicknesses of approximately 2.0 mm, 1.5 mm, and 1.0 mm, respectively. Because no two sleeves have the same thickness, and no combination of two sleeves is the same as the other, each positional combination will have a different gripping surface size. With four sleeves, the possible number of positional combinations increases to sixteen on each end of the socket or thirty-two total gripping surface configurations for a double ended multisocket. With sixteen (four sleeves) or even eight (three sleeves) different gripping surface sizes per end, nearly all sizes of fasteners can be gripped by one of the gripping surface sizes. Thus, a three or four sleeve multisocket could be used as a universal socket to fit nearly all sized square and hex-head rotary fasteners within its range of sizes.

Operational Description (FIGS. 2A-D, 3A&C, 4A-B, 5A-B, 6A-B)

In this operational section, the operations of the multisocket itself (FIGS. 2A through 3C) will be discussed first, and then the operation of the example multisocket wrenches (FIGS. 4A-B, 5A-B, and 6A) will be discussed.

All the pivotal double-ended multisockets presented in this patent can operate substantially like a standard socket, in that, the gripping surface of the multisocket is placed in contact with a rotary fastener and turned. The disclosed multisockets have the added operation of being able to change the size of its presented gripping surface, and this will be discussed first. In short, the user slides the appropriate sleeves to their desired position to create a specific gripping surface. Then the user pivots the socket head to the angle they want, and insert the multisocket over the rotary fastener to be turned. The multisockets can then be turned to rotate the rotary fastener. The addition of folding handles allows many configuration of the handles to be realized and specific operational positions for specific folding wrench systems will be discussed later in this document (see sections on FIGS. 4A-C, 5A-B, and 6A).

The actual act of using the multisocket end amounts to nothing more than engaging a rotary fastener with the proper size gripping surface and turning the wrench's handle (i.e. tool handle). However, the selection of the proper gripping surface size will be discussed here because of the novelty of this process.

In FIGS. 2A-D, we see a single-sleeve double-ended pivotal multisocket 30. Multisocket 30 can adjust its gripping surface sizes in a similar manner as double ended wrench tool 5 as seen in FIG. 1A. Wrench tool 5 can slide its inner sleeve 9 to the left or right with tab 7 that is connected to sleeve 9 and projects out of slot S. Similarly, sleeve 50 is slidably mounted within socket body 41 by moving a control post 53 and control pad 54 that project to the exterior of socket body 41 through slot(s) 44. With control pad(s) 54, the user can push and pull control pad 54 to move sleeve 50 to the left or right ends of outer socket 40. FIG. 2C shows sleeve 50 slide to its far left (flush with large end) and FIG. 2D shows sleeve 50 slide to its far right (flush with small end). This gives each end of multisocket 30 two different sized gripping surfaces depending on which position sleeve 50 is in. For example, with sleeve 50 slide to the left, as seen in FIG. 2C, large gripping surface 52*a* of sleeve 50 can be used on the large end of multisocket 30, while at the same time, small gripping surface 42*b* of socket body 41 can be used on the small end of multisocket 30. With sleeve 50 slide to the right as seen in FIG. 2C, large gripping surface 42*a* of socket body 41 can be used on the large end of multisocket 30, while at the same time, small gripping surface 52*b* of sleeve 50 can be used on the small end of multisocket 30. The sliding range 57*a-b* of sleeve 50 can be determined by the shape of the inner surface of socket body 41, the exterior shape of sleeve 50, the length and position of control slot 44 and control post 53. Sleeve 50 fits in outer socket 40 with very little play between the sleeve and socket body 41. This allows outer socket 40 to carry most of the stress and forces that result when the user tries to turn a rotary fastener with one of the sleeve's griping surfaces Inner sleeve 50 can be relatively thin and can be too weak to function as a socket by itself (without the support of outer socket 40). Latching mechanism 38 is a simple slide mechanism that is spring loaded to engage a pin within holes 35 or notches 36 on pivot post 45 mounted (forged) on the exterior of socket 40. To disengage the latch mechanism the user would pull the external tab to the right in FIGS. 2A and 2C-D to disengage the pin from pivot post 45. The user can then pivot multisocket 30 to a new position with respect to handle 31 and release the latch mechanism to allowing the pin to engage a different hole or notch on pivot post 45 to hold the multisocket in its new orientation. This type of locking or friction mechanism along with many others are relatively common in the prior art and many such locking mechanism and friction mechanism variations are possible.

In FIGS. 3A-C, we see multisockets 60 and 70, both of which have similar construction, and their size being the only substantial difference between the two. Because of this I will limit the operational discussion to multisocket 60 since FIG. 3A is a larger drawing and easier to read than FIG. 3C, and FIG. 3B shows a sectioned end view of multisocket 60 to help the reader understand its operation.

In FIG. 3A, we see a side view of multisocket 60 comprising outer socket housing 62, thick half-sleeve 63 and thin half-sleeve 64. Each sleeve 63 and 64 has its own control pad 63*c* and 64*c*, respectively. Moving control pad 63*c* to the left or right moves sleeve 63 to the left or right, respectively, by the same amount. Slot 62*c* on socket body 62 and notches 63*e* on sleeve 63 both act to limit the range of motion 63*d* of sleeve 63. This range of motion 63*d* is selected so that the left and right most edges of sleeve 63 is nearly flush with the left and right edges of socket body 62 when slide fully to the left and right respectively. Similarly, moving control pad 64*c* to the left or right moves sleeve 64 to the left or right, respectively, by the same amount. Slot 62*d* on socket body 62 and notch 64*e* on sleeve 64 both act to limit the range of motion 64*d* of sleeve 64. This range of motion 64*d* is selected so that the left and right most edges of sleeve 64 is nearly flush with the left and right edges of socket body 62 when slide fully to the left and right, respectively. Thus, the user can slide one or both sleeves to a particular end of socket body 62 to achieve the desired gripping surface size.

In FIGS. 3A-B and Table 1, we see that two slidable sleeves can provide four possible positional combinations (permutations—combinations where position matters) for the two sleeves. Table 1 shows these four positional combinations and the resulting gripping surface sizes created on both the large and small ends of multisocket 60. Four different gripping surfaces sizes can be obtained from each end of the multisocket as long as the thickness of sleeves 63 and 64 are not substantially the same. Choosing similar thicknesses result in two of the four combination having substantially the same gripping surface size. Selecting one thickness that is twice the thickness of the other sleeve is used here as one example because it can create a set of evenly spaced gripping surface sizes. For example, the 1 mm and 2 mm thickness chosen for sleeves 64 and 63, respectively allow four gripping surface sizes that are 1 mm apart from each other. This happens because the thickness 64*f* and 63*f*, of 1 mm and 2 mm, respectively, simply reduce the gripping surface size of outer socket 62 by their stated amount, while when they are both used their thicknesses add together to reduce the gripping surface size by 3 mm. Thus, a reduction of 0 mm, 1 mm, 2 mm, and 3 mm is realized with the two sleeves depending on their position, and the four sizes simply count down from 19 mm in increments of 1 mm on the large end, and count down from 15 mm in increments of 1 mm on the small end. This is a result of the selection of sleeve thicknesses 63*f* and 64*f* (2 mm and 1 mm, respectively). Multisocket 70 seen in FIG. 3C operates substantially in the same manner as multisocket 60, but with smaller components and smaller gripping surface sizes.

Many other sleeve thicknesses can be used to obtain a set of specific gripping surface sizes for a particular purpose. For example, if sleeves 63 and 64 were instead made ⅛ inch and 1/16 inch thick respectively, the resulting gripping surface sizes would change to SAE Standard sizes in increments of 1/16 inch. Note that sleeve 63 is again twice as thick as sleeve 64 to provide an evenly spaced range of gripping surface sizes. Alternatively, one could place a Metric sized socket housing and sleeves on the Left, and a SAE (Standard) sized socket housing and sleeves on the right. Then the multisocket can provide both Metric and Standard Socket sizes. In Tables 6 and 7 we see one example of how this combining of Metric and Standard sizes might be arranged in a complementary way with a pair of double-ended multisocket providing a complete set of Metric and SAE (Standard) gripping surface sizes.

TABLE 6

Large Multisocket - Alterative Resized Multisocket 60 with a socket body resized to 19 mm (3/4 inch) on the large end (left end), and 11/16 inch on the small end (right end).

| SLEEVE 63 POSITION (Left end = 3 mm Right end = 3/16" Thickness) | SLEEVE 64 POSITION (Left end = 2 mm Right end = 1/8" Thickness) | GRIPPING SURFACE SIZE (Large end) (Left end) | GRIPPING SURFACE SIZE (Small end) (Right end) |
|---|---|---|---|
| RIGHT | RIGHT | 19 mm & 3/4 inch | 3/8 inch |
| RIGHT | LEFT | 17 mm | 1/2 inch |
| LEFT | RIGHT | 16 mm & 5/8 inch | 9/16 inch |
| LEFT | LEFT | 14 mm | 11/16 inch |

TABLE 7

Small Multisocket - Alternative Resized Multisocket 70 with a socket body resized to 13 mm on its larger end (left end), and 7/16 inch (11 mm) on the smaller end (right end).

| SLEEVE 73 POSITION (Left end = 2 mm Right end = 1/8" Thickness) | SLEEVE 74 POSITION (Left end = 1 mm Right end = 1/16" Thickness) | GRIPPING SURFACE SIZE (Large end) (Left end) | GRIPPING SURFACE SIZE (Small end) (Right end) |
|---|---|---|---|
| RIGHT | RIGHT | 13 mm | 1/4 inch & 6.5 mm |
| RIGHT | LEFT | 12 mm | 5/16 inch & 8 mm |
| LEFT | RIGHT | 11 mm & 7/16 inch | 3/8 inch |
| LEFT | LEFT | 10 mm | 7/16 inch & 11 mm |

In Table 6, sleeves 63 and 64 have been resized with different thicknesses on each end of each sleeve (see above). Metric sizes have been placed on the Left ends of the sleeves, English Standard (SAE) sizes on the right ends. The selection of sleeve thicknesses shown allows the most used socket sizes to be provided for both Metric and Standard sizes. The first gripping surface size listed is the designed surface size. A second gripping size, if listed, represents a slightly off-sized gripping surface, but is so close that the designed gripping surface size can be used with that size rotary fasteners.

In Table 7, sleeves 73 and 74 have been resized with different thicknesses on each end of each sleeve (see above). Metric sizes have been placed on the Left ends of the sleeves, English Standard (SAE) sizes on the right ends. The modified multisocket provides incremental Metric and Standard sizes to provide the most used sizes.

Notice that in Tables 6 and 7, the thicknesses of the sleeves are not the same on both ends. The difference in thicknesses between the Left and Right ends of the sleeves can easily be accomplished by simply grinding one or both ends to the desired thickness before bending them into their final channel shape. By selecting the proper thicknesses for each sleeve all the common metric and standard sizes (as shown) can be realized with the pair of double-ended multisockets shown in Tables 6 and 7. Notice that in Table 6, the left ends of sleeves 63 and 64 were given a 3 mm and 2 mm thickness, respectively. This allowed the multisocket in Table 6 to skip the little used gripping surface sizes of 18 mm and 15 mm. Many standard socket sets do not come with these sizes anyway. Similarly, the right ends of sleeves 63 and 64 have been given a 3/16 inch thickness and a ⅛ inch thickness, respectively. This selection of thicknesses allows this multisocket to skip the gripping surface sizes of ⅝ and 7/16 inch to provide more metric sizes on the right-side of the multisocket. However, these sizes are not lost because it's the smaller companion multisocket seen in Table 7 will be provided these missing sizes. The ⅝ inch gripping surface can also be provided by the left end of the multisocket in Table 6, because its 16 mm gripping surface is very close in size to a ⅝ inch gripping surface. This combination of large and small multisockets (Tables 6 and 7), with interwoven gripping surface sizes, can provide all the common metric sizes between 6.5 mm and 19 mm, and provides all the Standard sizes between ¼ inch and ¾ inch in 1/16 inch increments. Thus, this set of two double-ended multisocket shown in Tables 6 and 7 can provide the following Metric and Standard socket sizes:

TEN METRIC SIZES: 6.5, 8, 10, 11, 12, 13, 14, 16, 17, and 19 mm

NINE STANDARD SIZES: ¼, 5/16, ⅜, 7/16, ½, 9/16, ⅝, 11/16, and ¾ inches

The reader should note that the above example multisockets in Tables 6 and 7, is only one example of the vast number of ways gripping surface sizes can be arranged on two double-ended two-sleeve multisockets. Thus, many other combinations can easily be created depending on the desire and needs of the user.

In FIGS. 3A-B, a pivot pin 65 can be installed through pivot holes 62*b* to provide a pivotal axis for multisocket 60. Pivot pin 65 can pass through notches 63*e* and 64*e* in sleeves 63 and 64 respectively. The shape of notches 63*e* and 64*e* can prevent sleeves 63 and 64 from sliding out of socket 62 once pivot pin 65 is installed through multisocket 60. The ends of pivot pin 65 are connected to a hinge paw handle (see FIGS. 5A-B and 6A) to provide a range of orientations for multisocket 60. Multisocket 70 seen in FIG. 3C provides the same pivotal mounting with a pivot pin 75 (see FIGS. 5A-B and 6A).

In FIG. 4A-B, we see multisocket 70*z* with a ratchet assembly 82 and 84, respectively. Both ratchet mechanisms are connected to ratchet ring 72*e* on the outer portion of socket housing 72*z*. In FIG. 4A, ratchet assembly 82 can operate substantially the same as prior art ratchets with a ratchet mechanism 82*b* selectively stopping ratchet ring 72*e* from rotating in one direction or the other inside ratchet housing 82*a* depending on the position of selector switch 82*c*. This can provide a relatively low profile ratchet for multisocket 70*z*. Pivot posts 82*d* are mounted on ratchet housing 82*a* and are designed to engage pivot holes 81*c* on hinge paw 81*b* on handle 81. Depending on the width of ratchet housing 82*a* and the width of hinge paw 81*b*, multisocket 70*z* can have a full three-hundred sixty degree range of rotation (large end of multisocket 70*z* can rotate through the gap in hinge paw 81*b*) or as little as ninety degrees of rotation and still retain much of its functionality.

In FIG. 4B, we see a ratchet assembly 84 that is similar to ratchet assembly 82 seen in FIG. 4A. In this particular design, housing 84*a* has an extended housing portion 84*b* so that pivot posts 84*d* can be offset from the centerline of multisocket 70*z*. This allows multisocket 70*z* to pivot to the sides of hinge paw 83*b* and also allows center support 83*e* to help strengthen hinge paw 83*b*. Because of the offset nature of hinge posts 84*d*, and the center support 83*e*, multisocket 70*z* can pivot through a range of approximately one-hundred eighty degrees to provide a full set of orientation angles for the multisocket. When using multisocket 70*z* like a screwdriver, notice that force on the multisocket in both position 79*a* and 79*b* tend to push multisocket 70*z* against center support 83*e* to provide a strong stable position for the multisocket during use, even if no holding mechanism like friction washer 84*c* were used.

In FIG. 5A, multisocket wrench 90 can have six or more functional positions: 1) a folded and stowed position (handles 91 and 92 folded together), 2) a folded operational position (multisockets 60 and 70 used like a screwdriver while in stowed position), 3) a short handle position (one socket pivoted ninety degrees with respect to its handle, and handles 91 and 92 are used as the grip handle), 4) a long handle operational position (handles folded out to a substantially inline position or straight position, and one socket is pivoted substantially perpendicular to the handles for use), 5) a short handle with extension position (one handle pivoted substantially perpendicular to the second handle (see position of handle 91 with handle 92 in position 92*y* (or position 92*z*) in FIG. 5A), with the one handle operating as an extension, and the other handle operating as a short grip handle to turn multisocket 60), and 6) a crank handle position (first handle pivoted substantially perpendicular to the second handle, and the socket on the second handle pivoted substantially perpendicular that handle so that the first handle can be used as a crank grip and the second handle operates as the crank). This list does not include the fact that each of the pivoting multisockets can be rotated to a multitude of angles to provide many additional positions between each of these major functional positions or modes. For example, the tool arms might be angled at forty-five degrees to allow a multisocket to reach an awkwardly positioned bolt head. Normally this would require a specialty wrench, but because of the variety of angles possible, the folding multitools disclosed here can simulate a number of curved and strangely shaped wrenches and ratchet wrenches.

In FIG. 5B, multisocket wrench 95 can have seven or more functional positions: 1) a folded and stowed position (handles 111 and 112 folded together against plier sections 102 and 101, respectively), 2) a folded operational position (multisockets 60 and 70 used like a screwdriver while in stowed position), 3) a short handle position (one socket pivoted ninety degrees with respect to its handle, and handles 111 and 112 are used as the short handle grip), 4) a long handle operational position (one handle folded out to a somewhat parallel position away from the other handle, and the extended multisocket is pivoted substantially perpendicular to its handle for use, and pliers 100 and the other handle used as an extended grip handle (shown in FIG. 5B)), 5) a driver handle position (one handle pivoted substantially perpendicular to the second handle, with the first handle operating as an extension, and the second handle operating as a short grip handle), 6) a crank handle position (first handle pivoted substantially perpendicular to the second handle with the socket on the second handle pivoted substantially perpendicular that handle so that the first handle can be used as a crank grip and the second handle operates as the crank), and 7) pliers handle position (both handles extended away from pliers 100 so that they can be used as the two hand grips for pliers 100). This list does not include the fact that each of the pivoting multisockets can be rotated to a multitude of angles to provide many additional positions between each of these major functional positions or modes.

In FIG. 6A, multisocket tool 120 can have seven or more functional positions: 1) a folded and stowed position (handles 121*a*, 122 and 123 folded together adjacent screwdriver assembly 125), 2) multiple short handle position (one short handle position shown in FIG. 6A for specialty tool 121), 3) a long handle operational position (one handle folded out to a substantially parallel position away from the other handle, and the extended multisocket is pivoted substantially perpendicular to its handle for use), 4) a driver handle position (one handle pivoted substantially perpendicular to a second handle, with the first handle operating as an extension, and the second handle and screwdriver assembly operating as a short grip handle), 5) a crank handle position (one handle pivoted substantially perpendicular to the other handles with the socket on the one handle pivoted substantially perpendicular that handle so that the other handles and screwdriver assembly 125 can be use as a crank grip), 6) double handle position (either handle 122 or 123 pivoted ninety degrees away from screwdriver assembly 125 and the second handle pivoted one hundred eighty degrees to an opposed and substantially parallel relation with screwdriver assembly 125. Screwdriver assembly 125 and the second handle are used as the double handles, and the first handle operates as an extension for its multisocket), and 7) screwdriver handle position (both handles extended behind central hub 124 to use multisockets 60 and 70 as the screwdriver grip handle). This list does not include the fact that each of the pivoting multisockets can be rotated to a multitude of angles to provide many additional positions between each of these major functional positions or modes.

Tool Operation

Though not discussed specifically here, the use of the wrench heads and other common hand tools are common knowledge. For use of wrenches, the wrench gripping surface is placed in contact with the rotary fastener's head and torque is applied to the wrench handle to turn the fastener. For other tools such as hammers, screwdrivers, pliers and others, most people intuitively know how to use these even if other pivotal arms are surrounding it in a stowed position. It is somewhat intuitive to pivot additional unneeded tools away from the tool you want to use. However, because of the multitude of possible configurations of the tool handles, a few specific examples will be discussed here to ensure compete understand.

Stowed Positions (FIGS. 5A-B, and 6A)

In FIG. 5A, multisocket wrench 90 is shown in its folded and stowed position. Handles 91 and 92 are substantially parallel and adjacent. In FIG. 5B, multisocket wrench 95 would be in its stowed position of handle 111 and multisocket 60 were folded against pliers section 102. In FIG. 6A, multisocket tool 120 can be put in a fully stowed position by pivoting tool 121 against screwdriver holder 124*c*.

Stowed Operation (FIG. 5A)

In FIG. 5A, multisocket wrench 90 is shown in its stowed position with handles 91 and 92 substantially parallel and adjacent. The large ends of multisockets 60 and 70 can presently be used by gripping handles 91 and 92 like a screwdriver handle to provide a stowed yet operational position.

Short Handle Operation (FIG. 6A)

All of the multitool designs disclosed in this patent can use some of their tools in a short handle mode. In most cases this is not the preferred position because of the somewhat awkward position of the multisocket being used. However, in tight quarters where a long handle will not fit, this short handle mode can be used. In FIG. 6A, either multisockets 60 and 70 can be pivoted ninety degrees to to present their gripping surface for use in turning a rotary fastener. The remainder of the wrench would then be used as the handle (handles 122, 123, screwdriver assembly 125 and central hub 124).

Long Handle Operational Position (FIG. 5B)

In FIG. 5B, multiwrench 95 is shown pivoted to a long handle position, where multisocket 60 is positioned for use, and handle 112, multisocket 70, and pliers 100 can be used as an extended hand grip on handle 111 for turning multisocket 60.

Tool Extension Operation (FIG. 6A)

In FIG. 6A, each handle can be pivoted ninety degrees away from screwdriver assembly 125 an the other handles to act as an extension to extend that handle's socket into a recess to reach a rotary fastener. Handle 121*a* is shown being used as a socket extension with handles 122 and 123, and screwdriver assembly 125 operating as a short handle for specialty tool 121*b*.

RAMIFICATIONS, and SCOPE

The disclosed pivotal double-ended multisockets can provide a full set of tools in a convenient double ended multisocket. When combined in pairs, the multisockets can provide eight or more different gripping sizes in a single wrench. The multisockets can also be combined with folding handles to provide the wrench with a folded and stowed position, while also allowing an extended handle position where one of the multisockets is used as a handgrip for the extended tool. Other tools may also be attached to the basic two multisocket design to allow specialty tools for specific industries.

Although the above description of the invention contains many specifications, these should not be viewed as limiting the scope of the invention. Instead, the above description should be considered illustrations of some of the presently preferred embodiments of this invention. For example, the pivot hinge for the multisockets are shown in this patent are substantially in the middle lengthwise of the multisocket, but there is no reason the pivot hinge cannot be placed further toward one end or the other to provide a longer effective socket handle (socket end is further from the pivot hinge) for one end of the multisocket or the other. Note that the pivot hinge in FIG. 4B is still near the lengthwise middle of multisocket 70*z*, though it is off-set to the side of the multisocket. It should also be obvious that more sleeves can be added to the multisocket designs, however, having greater than four different socket sizes per end can quickly make the physical difference in size between the largest gripping surface and the smallest gripping surface on one end of a multisocket can be detrimental to the ergonomic use of the multisocket. This is the large exterior dimensions of the multisocket end can interfere with getting it into tighter spaces typical around smaller rotary fasteners that use the smaller gripping surfaces.

Different gripping surface types can be used with all the disclosed socket bodies and sleeves. The slidable sleeves can be shaped to closely follow the contours and corners of the different gripping surfaces. Many common gripping surfaces can be used in the disclosed multisockets, such as, twelve point standard, six and twelve point spline, six and twelve point lobe, Torex®, and other specialty gripping surface types.

From the above discussion we can see that the disclosed pivotal double-ended multisockets can be added to nearly any kind of wrench handle system. Other embodiments can comprise additional hinges placed within the handle(s) to provide additional folding of a multisocket wrench. Also many different shapes are possible for the handles to provide various ergonomic advantages and the straight handle shapes shown here are only examples that were easy to draw, but many more organic shapes (gently curved arms) can be easily adapted for use in a multisocket tool. The reader should further understand that many other tools can be used with the disclosed folding multitool design than the common tools presented here. For example, the screwdriver assembly 125 could be replaced with a handle that comprises a Swiss army knife like tool, with multiple fold out knives, screwdrivers, spoon, fork, etc. Finally, while many ergonomic examples have been shown here, these are only the personal preference of the Inventor, and many additional ergonomic designs can be made, depending greatly on specific user needs. For example, for a carpenter, their personal preference might be to replace screwdriver assembly 125 with a hammer or a nail puller claw which could be ergonomic used by folding handles 122 and 123 back and gripping them together as a handle for the hammer or nail puller claw. Other professionals may want other specialized tools for electrical, carpentry, and/or other building related tools to replace one of the multisockets, and the remaining multisocket having specific gripping surface sizes for their industry. For other industries, significantly different configurations and tools might be considered more useful or ergonomic.

Further, it should be noted that a quadruple sleeve design can be made with as many as thirty-two separate gripping surface configurations (sixteen different gripping surface sizes on each end). This quadruple sleeve design can use four separate sleeves that are spaced around the interior circumference of the socket housing and each cover approximately one-quarter of the interior of the socket housing. This would be similar to the three sleeves 133, 134 and 135, seen in FIG. 6C, each cover approximately one-third of the entire interior of the socket housing. With four sleeves there can be sixteen unique configurations for the four sleeves within the socket housing. These sixteen unique positions can provide sixteen different gripping surfaces for each end. One way to use many of these configurations is to have two sleeves with metric thicknesses and two sleeves with standard thicknesses. This can allow a wrench to have both metric and standard sized gripping surfaces on the same multisocket end without a large size change between the largest and smallest sizes on a particular end of the multisocket. Alternatively, finer size increments can be enabled by using thinner sleeves. With thinner sleeves the size difference between configurations can be made small enough that the socket becomes substantially a universal socket. Additional stabilizing means can also be used to help stabilize the longitudinal position of the sleeves as they slide back and forth, and are used to turn rotary fasteners. For example, the edges of each sleeve can be bent outward a short distance to provide more surface area for the sleeves to butt against each other. These outward bent ends of the sleeves can extend into longitudinal grooves on the interior of the outer socket housing (socket body) to further stabilize the longitudinal position of the sleeves. Thus, there would be more surface area at edges of adjacent sleeves for butting up against each other and holding each sleeve in place within the socket housing during use. Finally, the sleeves do not have to butt up against one another inside the socket body, but can cover only a portion of the interior surface since the control pad(s) can be tightened to hold the sleeve against the interior of the socket body (interior gripping surfaces).

Thus, the scope of this invention should not be limited to the above examples, but should be determined from the following claims.

I claim:

1. A wrench tool, comprising:

a) a multisocket comprising:

i) a socket body comprising a first and second socket ends, an elongated channel extending through the socket body from the first socket end to the second socket end, and a longitudinal slot in the socket body, wherein the first and second socket ends define a first and second rotary fastener gripping surfaces respectively within the elongated channel;

ii) a first slidable sleeve with a first and second sleeve ends defining a third and forth rotary fastener gripping surfaces respectively, wherein the first slidable sleeve is slidably mounted in sliding contact with the elongated channel and slidable between a first and second operational positions, wherein the first and second sleeve ends define a third and fourth rotary fastener gripping surfaces respectively, wherein the wall thickness of the first slidable sleeve is insufficient to support general use in turning a rotary fastener without structural support from the first and second rotary fastener gripping surfaces;

iii) a control mechanism connected to the first slidable sleeve and extending through the longitudinal slot to an exterior of the socket body, wherein the control mechanism is adjustable by a user for alternately sliding the first slidable sleeve between the first and second operational positions;

iv) wherein the first end of the first slidable sleeve when in the first operational position is substantially supported by the first rotary fastener gripping surface of the socket body and allows the third rotary fastener gripping surface to be used for turning the third rotary fastener size without damage to the first slidable sleeve;

v) wherein the second end of the first slidable sleeve when in the second operational position is substantially supported by the second rotary fastener gripping surface of the socket body and allows the forth rotary fastener gripping surface to be used for turning the forth rotary fastener size without damage to the first slidable sleeve, and b) a first handle comprising a pivot hinge end, wherein the pivot hinge end is pivotally attached to the socket body, wherein the first handle can be used to turn the multisocket for tightening and loosening a rotary fastener.

2. The wrench tool in claim 1, further comprising a holding mechanism connected to the socket body for temporarily holding and/or locking the first slidable sleeve in either the first or second operational positions with respect to the socket body.

3. The wrench tool in claim 1, further including a second multisocket with a rotary fastener gripping surface that are smaller than each of the rotary fastener gripping surfaces on the first multisocket, wherein the first handle defines a second pivotal end that is pivotally connected to the second multisocket.

4. The wrench tool in claim 3, wherein the first handle defines a left and right folding handles pivotally attached at a folding hinge, wherein the left and right handles are foldable about the folding hinge to a stowed position, wherein the first and second multisocket are substantially adjacent one another in the stowed position.

5. The wrench tool in claim 1, further including a second slidable sleeve with two ends defining a fifth and sixth rotary fastener gripping surfaces, wherein the second slidable sleeve is slidably mounted in sliding contact with the elongated channel and independently slidable between a first and second operational positions, and wherein the first and second slidable sleeves are positioned substantially adjacent and oppose to each other within the elongated channel.

6. The wrench tool in claim 5, further comprising a first and second holding mechanism connected to the socket body for temporarily holding and/or locking the first and second slidable sleeves respectively in one of the operational position.

7. The wrench tool in claim 5, further including a second multisocket with a rotary fastener gripping surface that are smaller than each of the rotary fastener gripping surfaces on the first multisocket, wherein the first handle defines a second pivot hinge end that is pivotally connected to the second multisocket.

8. The wrench tool in claim 7, wherein the first handle defines a left and right folding handles pivotally attached at a folding hinge, wherein the left and right handles are foldable about the folding hinge to a stowed position, wherein the first and second multisocket are substantially adjacent one another in the stowed position.

9. The wrench tool in claim 1, wherein the first and second slidable sleeve comprise half-sleeves that each cover approximately half the interior of the elongated channel, rein when both the first and second slidable sleeves are in their first operational position their first ends combine to define a seventh gripping surface for turning a seventh size of rotary fastener, and when both the first and second slidable sleeves are in their second operational position their second ends combine to define an eighth gripping surface for turning an eighth size of rotary fastener.

10. The wrench tool in claim 1, wherein a first longitudinal axis of the socket body can be pivoted to a first and a second parallel orientation with respect to a second longitudinal axis of the first handle, wherein both the first and second socket ends can be used like a screwdriver by turning the first handle around the second longitudinal axis.

11. The wrench tool in claim 1, further including one or more additional slidable sleeves each with a first and second gripping surface end and mounted in sliding contact with the elongated channel, wherein each one or more additional slidable sleeves is independently slidable between a first and second operational position.

12. The wrench tool in claim 1, further comprising a second handle, a second multisocket and a pliers, wherein the pliers comprises a left and right plier arms pivotally connected to provide opposed gripping surfaces, wherein the second multisocket comprises a construction similar to the first multisocket and provides at least three unique rotary fastener gripping surfaces for use, wherein the second multisocket is pivotally attached to the second handle at a second pivot hinge end, wherein the first and second handles are pivotally attached to the left and right plier arms respectively, wherein the first and second handles are pivotal to a stowed position and an extended position, wherein the first and second handles are longitudinally adjacent the pair of pliers in the stowed position, and wherein in the extended position the left and right handles are extended away from the pliers and function as a pair of grip handles for the pliers for grasping objects with the opposed gripping surfaces.

13. The wrench tool in claim 12, further including one or more additional slidable sleeves each with a first and second gripping surface end and mounted in sliding contact with the elongated channel of the multisocket or second multisocket, wherein each one or more additional slidable sleeves is independently slidable between a first and second operational position.

14. The wrench tool in claim 1, further comprising a second handle, a second multisocket and a screwdriver assembly, wherein the screwdriver assembly comprises a screwdriver and a central hub, wherein the central hub is attached to one end of the screwdriver assembly and defines a first and second hub hinge, wherein the second multisocket comprises a construction similar to the first multisocket and provides at least three unique rotary fastener gripping surfaces for use, wherein the second multisocket is pivotally attached to the second handle at a second pivotal hinge end, wherein the first and second handles are pivotally attached to the first and second hub hinge respectively, wherein the first and second handles are pivotal to a stowed position and an extended position, wherein the first and second handles are longitudinally adjacent the screwdriver assembly in the stowed position, and wherein in the extended position the left and right handles are extended away from the screwdriver assembly and substantially adjacent each other so that the user can grasping the first and second handles as a handle for use with the screwdriver assembly.

15. A wrench tool, comprising:

a) a pivotal double-ended multisocket, comprising:

i) a socket body comprising a first and second socket ends, an elongated channel extending through the socket body from the first socket end to the second socket end, and a first and second longitudinal slots defined on the socket body, wherein the first and second socket ends define a first and second rotary fastener gripping surfaces respectively within the elongated channel;

ii) a pivotal means defined on the exterior of the socket body for pivotally mounting the socket body to a handle for use;

iii) a thick slidable sleeves comprising two ends defining a third and forth rotary fastener gripping surfaces and a thin slidable sleeve comprising two ends defining a fifth and sixth rotary fastener gripping surfaces, wherein the thick and thin slidable sleeves are mounted in sliding contact with the elongated channel and slidable between a left and right operational positions, wherein the thick and thin slidable sleeve are structurally supported by the socket body when used to turning a rotary fastener;

iv) a first and second control mechanisms connected to the thick and thin slidable sleeves respectively and extending through the first and second longitudinal slots respectively to an exterior of the socket body, wherein the first and second control mechanisms are adjustable by a user for sliding the thick and thin slidable sleeves respectively between four unique positional combinations to provide the multisocket with up to eight different gripping surface sizes for use.

16. The wrench tool in claim 15, further a second pivotal double-ended multisocket, wherein the second pivotal double-ended multisocket comprising a structure substantially similar to the first pivotal double-ended multisocket and providing up to eight additional different gripping surface sizes, wherein the second pivotal double-ended multisocket comprises at least four rotary fastener gripping surfaces that are different in size from the gripping surfaces sizes of the first pivotal double-ended multisocket, wherein the second pivotal double-ended multisocket is pivotally mounted to an opposite end of the handle.

17. The wrench tool in claim 16, wherein the handle comprises a left and right folding handles pivotally attached at a folding hinge, wherein the left and right handles are foldable about the folding hinge to a stowed position wherein the first and second pivotal double-ended multisocket substantially adjacent one another.

18. The wrench tool in claim 16, further including one or more additional slidable sleeves each with a first and second gripping surface end and mounted in sliding contact with the elongated channel of either the pivotal double-ended multisocket or second pivotal double-ended multisocket, wherein each one or more additional slidable sleeves is independently slidable between a first and second operational positions.

19. The wrench tool in claim 16, further including a pliers comprising a top and bottom plier arms that are pivotally connected to each other with opposed gripping surfaces, wherein the handle comprises a left and right handles that are pivotally attached to the top and bottom plier arms respectively, wherein the left and right handles are individually pivotal to a stowed position and an extended position, wherein the stowed position defines the left and right handles that are positioned longitudinally adjacent the pliers, and wherein in the extended position the left and right handles are extended away from the pliers and function as a pair of grip handles for the pliers for grasping objects with the opposed gripping surfaces.

20. The wrench tool in claim 15, further comprising a second handle, a second multisocket and a screwdriver assembly, wherein the screwdriver assembly comprises a screwdriver, and a central hub, wherein the central hub is attached to one end of the screwdriver assembly and defines a first and second hub hinges, wherein the second multisocket comprises at least three unique rotary fastener gripping surfaces for use, wherein the second multisocket is pivotally attached to the second handle at a second pivot hinge end, wherein the first and second handles are pivotally attached to the first and second hub hinges respectively, wherein the first and second handles are pivotal to a stowed position and an extended position, wherein the first and second handles are longitudinally adjacent the screwdriver assembly in the stowed position, and wherein in the extended position the left and right handles are extended away from the screwdriver assembly and substantially adjacent each other so that the user can grasping the first and second handles as a handle for use with the screwdriver assembly.

* * * * *